US007527178B2

(12) United States Patent
Lewis

(10) Patent No.: US 7,527,178 B2
(45) Date of Patent: May 5, 2009

(54) ELECTRONIC VISCOUS LIQUID DISPENSER

(75) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 771 days.

(21) Appl. No.: 10/748,864

(22) Filed: Dec. 30, 2003

(65) Prior Publication Data

US 2005/0139617 A1 Jun. 30, 2005

(51) Int. Cl.
*B65D 88/54* (2006.01)

(52) U.S. Cl. ..... 222/333; 222/63; 222/105; 222/181.3; 222/321.8; 222/325; 222/383.1

(58) Field of Classification Search ..... 222/181.3, 222/333, 63, 383.1, 180, 105, 321.8, 325, 222/385, 372, 373
See application file for complete search history.

(56) References Cited

U.S. PATENT DOCUMENTS 4,722,372 A * 2/1988 Hoffman et al. ..... 141/98
5,249,718 A * 10/1993 Muderlak ..... 222/333
5,492,247 A * 2/1996 Shu et al. ..... 222/63
6,533,145 B2 3/2003 Lewis et al.
6,543,651 B2 4/2003 Lewis et al.
6,575,334 B2 6/2003 Lewis et al.
6,575,335 B2 6/2003 Lewis et al.
6,607,103 B2 * 8/2003 Gerenraich et al. ..... 222/183
6,648,179 B2 11/2003 Lewis et al.
6,729,502 B2 5/2004 Lewis et al.
7,028,861 B2 * 4/2006 Sayers et al. ..... 222/1
7,191,920 B2 * 3/2007 Boll et al. ..... 222/333

FOREIGN PATENT DOCUMENTS

EP 0341757 A2 11/1989

* cited by examiner

*Primary Examiner*—Frederick C. Nicolas
(74) *Attorney, Agent, or Firm*—Dority & Manning, P.A.

(57) ABSTRACT

An electronic self contained viscous liquid dispenser includes a housing defining an internal liquid reservoir. A dispensing pump mechanism is carried by the housing and disposed in liquid communication with the reservoir. The pump mechanism has a delivery end disposed for delivering metered doses of viscous liquid from the reservoir. A mounting assembly is configured for mounting on a supporting wall structure, with the housing being releasably attachable to the mounting assembly. An electronic actuating mechanism is carried by the mounting assembly and includes a motor driven actuator that engages with the pump mechanism upon insertion of the housing into the mounting assembly. A motor and associated power supply circuitry is carried by the mounting assembly, with the motor being in driving engagement with the motor driven actuator.

18 Claims, 15 Drawing Sheets

ELECTRONIC VISCOUS LIQUID DISPENSER

FIELD OF THE INVENTION

The present invention relates to the field of viscous liquid dispensers, for example soap dispensers, shampoo and lotion dispensers, food product dispensers, and the like.

BACKGROUND OF THE INVENTION

Various configurations and models of liquid dispensers, particularly liquid soap dispensers, are well known in the art. Conventional dispensers utilized, for example, in public restrooms and the like, are wall mounted units that typically include a housing structure that is permanently affixed to a wall. These dispensers may include an access door or member so that the dispenser can be opened by a maintenance person for refilling or servicing. With certain types of dispensers, separate refill cartridges are inserted into the housing structure. With other types of dispensers, the maintenance technician must directly refill a reservoir provided in the housing structure. The dispensers typically include a delivery device, such as a dosing pump, and a device such as a lever or button for actuating the dosing pump. The dispensers may be vented or unvented.

The conventional dispensers depend on the continued maintenance and operability of the housing structure, and particularly the dosing pump, that is permanently affixed to the wall. If the housing structure or dosing pump is damaged or vandalized, the dispenser becomes inoperable and must be replaced. The conventional dispensers also depend on a supply system wherein additional liquid soap must be separately stored, transported, and loaded into the dispensers. This process entails unnecessary logistic and manpower resources.

Advancements in viscous liquid dispensers are described, for example, in U.S. Pat. Nos. 6,533,145; 6,543,651; 6,575,334; and 6,575,335. These references describe various configurations of viscous liquid dispensers having a housing that defines an integral sealed internal liquid reservoir. In other words, the liquid reservoir is not a separate component from the housing, such as a cartridge or the like. The housing may be comprised of wall members that give the dispenser its outward appearance and also define the internal liquid reservoir. A manually actuated pump mechanism is disposed at least partially within the reservoir and has a delivery end that extends out of the reservoir and is actuated by a user to dispense the viscous liquid. The back side of the housing attaches to a bracket mounted on a wall or other supporting structure such that the bracket is not visible. When depleted, the dispenser is simply removed from the bracket and replaced with another dispenser.

Automation is also a desirable feature in the industry for many dispenser environments, such as public restrooms and the like. In this regard, various electronic dispenser designs have been suggested for dispensing a measured amount of stored liquid either automatically upon sensing the presence of a user, or upon manual actuation of an automated dispensing mechanism.

The present invention offers an automated electronic dispenser that combines the advantages of automatic "hands-free" dispensing with the improved dispensers such as those described in the U.S. patents referenced above.

SUMMARY

Objects and advantages of the invention will be set forth in part in the following description, or may be obvious from the description, or may be learned through practice of the invention.

The present invention provides an electronic self-contained viscous liquid dispenser. Although having particular usefulness as a liquid soap dispenser, the dispenser according to the invention is not limited to a liquid soap dispenser and may be utilized in any application wherein it is desired to dispense metered doses of a viscous liquid. The liquid dispenser will be described herein with reference to a soap dispenser for ease of explanation.

The viscous liquid dispenser includes a housing that may be formed of any suitable material. For example, the housing may be molded from relatively inexpensive plastic materials and may have any desired aesthetic shape. The housing also defines an integral sealed internal liquid reservoir. In other words, the liquid reservoir is not a separate component from the housing, such as a cartridge or the like. The housing may be comprised of wall members that give the dispenser its outward appearance and also define the internal liquid reservoir.

A dispensing pump mechanism is disposed at least partially within the reservoir. The pump mechanism has a delivery end that extends out of the reservoir for delivering metered doses of viscous liquid from the reservoir.

A mounting assembly is provided and configured for mounting on a supporting wall structure. The mounting mechanism may take on any number of suitable configurations, as described in greater detail herein. The housing is releasably attachable to the mounting mechanism.

An electronic actuating mechanism is carried by the mounting assembly and includes a motor driven actuator that engages with the pump mechanism upon insertion of the housing into the mounting assembly. A motor and associated power supply circuitry are also carried by the mounting assembly, the motor being in driving engagement with the motor driven actuator. Power may be supplied by one or more replaceable batteries also carried by the mounting assembly, or may be from a direct hard-wire supply, for example from a buildings AC system.

In a particular embodiment, the mounting assembly includes an enclosed back unit that is mountable against the supporting wall structure. The motor, power supply, and control circuitry may all be housed within the enclosed back unit. A releasable mounting mechanism is provided between the back unit and housing, and the back of the housing may be flush against the front surface of the back unit upon mounting the housing to the mounting assembly. The mounting mechanism may be, for example, a mounting bracket provided on the back unit that engages within a recess defined in the back surface of the housing. The recess may have side walls with engaging structure that engages with complimentary engaging structure provided on the mounting bracket. It may be desired that the recess have dimensions so that the complimentary structure on the mounting bracket fits entirely within the recess in the back of the housing. In this way, upon mounting the housing to the back unit, the back of the housing is flush against the back unit.

In an alternate embodiment, the mounting assembly may include an enclosed top unit that is disposed above the housing. This assembly may also include a back unit to which the housing is mounted. The motor, power supply, and control circuitry may all be housed within the top unit. Any suitable gearing arrangement may be provided between the motor and the drive actuator disposed below the housing. The gearing arrangement may extend through the back unit.

In still an alternate embodiment, the mounting assembly may include a base unit, with the motor driven actuator slidable within the base unit. The motor, power supply, and control circuitry may be housed in the base unit. The housing may be supported at least partially by the base unit. For example, the housing may rest on the base unit while also being attached to the supporting wall structure. In an alternate embodiment, the housing may be supported essentially entirely on the wall structure and disposed above the base unit with the motor driven actuator remaining in engagement against the pump mechanism.

The dispensing pump mechanism may take on any number of suitable configurations. In one embodiment, the mechanism includes a linearly slidable cylinder having a delivery channel defined therethrough that terminates in the delivery end. A valve mechanism is disposed in the delivery end of the pump cylinder and is configured to close upon return movement of the cylinder to its rest position to prevent leakage or dripping of liquid from the pump cylinder. The cylinder is slidable within a substantially horizontally disposed pump chamber defined within the reservoir. In one embodiment of the pump mechanism, the pump cylinder is insertable into the pump chamber from its back end. The chamber includes retaining structure, such as a flange member or the like, at its front end to prevent withdrawal of the pump cylinder from the pump chamber through the front end. A cap member or like device is attached to the back end of the pump chamber once the cylinder has been inserted into the chamber. The cap member has an orifice defined therethrough for drawing liquid into the pump chamber. A check valve device, such as a shuttle valve, is disposed in the orifice to close the orifice upon actuation of the pump cylinder.

In an alternate pump mechanism embodiment, an insert member is inserted through an opening defined in a front surface of the housing. The insert member extends into the reservoir and defines an internal pump chamber having a back end open to the reservoir and a front end open to the outside of the housing. The insert member is attached to the housing at the opening by any suitable mechanism. In one particular embodiment, the housing comprises a plurality of protrusions extending from the front surface and disposed around the opening. The insert member comprises a front flange having a plurality of counter-bored holes defined therethrough into which the protrusions extend upon mounting the insert member into the housing. The protrusions are then heated to a molten state wherein the protrusion material flows into the counter-bored holes and permanently affixes the insert member to the housing upon re-solidifying. If it is desired to recycle or reuse the pump mechanism, a less permanent or temporary type of attachment mechanism may be used to affix the insert member to the housing, such as a releasable adhesive, mechanical connection (i.e., threaded engagement), etc.

At least one seal is disposed between an outer surface of the insert member and the housing to ensure that liquid within the reservoir does not leak out from around the insert member. In one particular embodiment, this seal is a radially inwardly extending seal disposed around the opening in the housing that engages and seals against an outer surface of the insert member. This seal may be provided on a cylindrical extension of the housing that extends from the front surface into the reservoir. In an alternate embodiment, the seal may be a radially outwardly extending seal disposed at a forward end of the insert member that engages and seals against a portion of the housing defining the opening. It may be desired to use both types of seals in the same embodiment.

An alternative embodiment of a pump cylinder that may be used with an integrally formed pump chamber or pump chamber insert is also provided. This pump cylinder may include multiple components. For example, in one embodiment, the pump cylinder includes a first component and a second component inserted into a chamber defined in the first component. Longitudinally extending channels in the components align to define a delivery channel through the pump cylinder. This channel terminates at a delivery orifice defined in a delivery end of the pump cylinder. Once combined, the components define a complete pump cylinder that is slidable within the pump chamber from a rest position to a pressurizing position wherein liquid drawn into the pump chamber is pressurized and dispensed through the delivery channel and out the dispensing orifice.

In order to seal the pump cylinder relative to the pump chamber, a first radially extending seal, such as a flange seal, may be provided on the first component of the pump cylinder that slidably engages along a wall defining the pump chamber. A second similar seal may be provided on the second component that also slidably engages along the pump chamber wall.

In various embodiments, the motor driven actuator is slidable in a horizontal path to engage and move the pump cylinder to a dispensing position within the pump chamber. The cylinder need not be engaged by the actuator as it returns to its rest position. For example, the cylinder may return to its rest position by an internal pump spring. The chamber and cylinder are configured such that, as the cylinder returns, it draws liquid from the reservoir into the pump chamber for the next dispense cycle. For example, the pump chamber can be formed integral with the housing within the reservoir and have a back end open to the reservoir and a front end open to the outside of the housing. The delivery end of the pump cylinder extends out of the front end of the chamber and is engaged by the motor driven actuator.

Motive force from the motor may be applied to the actuator in any number of suitable embodiments. In a particular embodiment, the motor includes an off-center drive cam engaged within an elongated cam surface defined in the motor driven actuator. This eccentric or off-center cam arrangement converts rotational movement of the motor shaft to linear movement of the motor driven actuator, which in turn engages and moves the pump cylinder in a linear path from its rest position to a dispensing position wherein a metered dose of the viscous liquid is expelled from the pump chamber and out of the delivery end of the pump cylinder. For example, the motor driven actuator may be an elongated plate member slidably supported in the mounting assembly, for example in a base unit disposed below the housing. The plate member may have a front end engaged with the pump mechanism. For example, the plate member may have an angled front end that simply engages against the front surface of the pump cylinder. An opening (i.e., an elongated slot) may be defined in the plate member proximate to the front end and aligned with the delivery end of the pump mechanism such that the metered dose of liquid is dispensed through the opening in the plate member.

Operation of the electronic actuating mechanism may be initiated manually. For example, a push-button or similar device may be provided with the mounting assembly wherein a user initiates a dispensing sequence by manually pushing the button or otherwise actuating the manual device. In an alternate embodiment, a sensor may be provided and integrated with the control circuitry for automatic initiation of the dispensing sequence. The sensor may be, for example, a heat sensor, motion sensor, or any one or combination of sensors widely known and used for detecting the presence of a user in relatively close proximity to the dispenser.

It may also be desired to provide a manual actuator in the event that the electronic actuating mechanism is vandalized or otherwise becomes inoperative. This manual actuator may be, for example, a relatively simple push-plate, button, or like device that engages directly or indirectly against the front of the pump mechanism such that the user can manually dispense a metered dose of liquid merely by pushing or otherwise actuating the manual actuator.

In alternate embodiments of a dispenser according to the invention, the housing may be attached directly to the supporting wall structure. For example, as discussed above, the housing may include a vertical back side with a recess defined therein. The recess may include engaging structure defined therein, for example along one or more side walls, for engagement with complimentary structure of a wall bracket that is separately mounted on the supporting wall surface. A drive module is mountable on the supporting wall surface below the wall bracket and houses the motor driven actuator, motor, and associated control circuitry. The drive module may also house a portable power supply, such as replaceable batteries. The module and bracket are spaced such that upon mounting the housing to the wall bracket, the pump mechanism (i.e., the front end of the pump cylinder) is engaged by the motor driven actuator.

In a particular embodiment, the drive module is a base unit disposed below the housing, and the motor driven actuator may be slidably mounted in the base unit. The housing may rest on the base unit or be spaced from the unit, so long as the motor driven actuator is engaged with the pump mechanism to move the mechanism from its rest position to a dispensing position.

Any combination of the various other features discussed above may be incorporated with the wall mounted housing embodiment.

With the various embodiments, the electronic components, driven actuator, and so forth, are separate from the housing yet easily integrated with the housing. The individual housing units are easily detachable from the mounting assembly or supporting wall structure for disposal or recycling once the liquid has been depleted, wherein a new housing is then attached to the wall surface or seated in the mounting assembly.

As mentioned, the housing structure is preferably formed from a relatively inexpensive molded plastic and may comprise separately molded components that are permanently affixed or adhered to each other. For example, the housing may include a front component that is formed separately from and adhered to a back component. It may be desired that the front and back components have different characteristics. For example, it may be desired that the back component is more rigid than the front component to provide enhanced structural support and rigidity to the dispenser mounted on the wall structure. This may be accomplished by simply making the back component thicker than the front component.

It may also be desired to make at least a portion of the housing translucent or clear so that a maintenance technician can easily determine the remaining level of liquid within the reservoir. For example, a window may be provided in the housing. In one particularly useful embodiment, the housing includes a back component that is formed from a translucent material so that the entire volume of the reservoir is visible from the outside.

A vent path is defined into the reservoir to prevent drawing a vacuum therein. In a particular embodiment, the vent is provided in a top surface of the housing structure. Since the housing structure is mounted vertically, there is little concern of the liquid leaking from the vent in the top surface. In other embodiments, the reservoir may be vented through the pump mechanism. However, venting through the pump mechanism may result in undesired leakage through the mechanism, particularly if the pump mechanism is disposed in the lower portion of the housing. Venting may also be accomplished through the valve mechanism in the delivery end of the pump cylinder.

The invention will be described in greater detail below with reference to particular embodiments illustrated in the figures.

DETAILED DESCRIPTION

Figure 1:
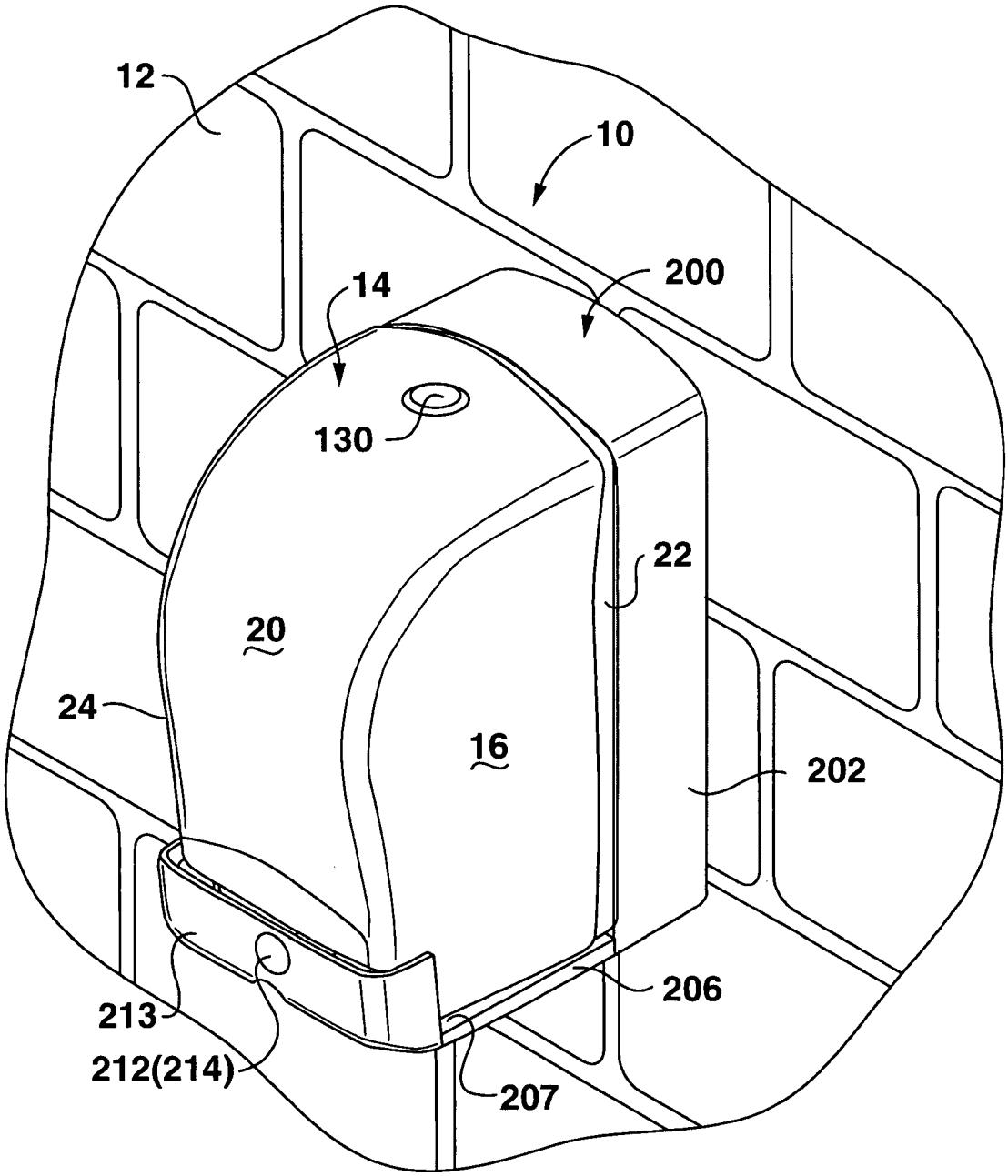
FIG. 1 is a perspective view of a dispenser according to the present invention.

Reference will now be made in detail to embodiments of the invention, one or more examples of which are illustrated in the drawings. Each example is provided by way of explanation of the invention, not meant as a limitation of the invention. For example, features illustrated or described as part of one embodiment, may be used with another embodiment, to yield still a further embodiment. It is intended that the present invention include modifications and variations to the embodiments described herein.

Various features of the present invention are described in detail in U.S. Pat. Nos. 6,533,145; 6,543,651; 6,575,334; and 6,575,335, all commonly owned by the present assignee, Kimberly-Clark Worldwide, Inc. These patents are incorporated herein in their entirety for all purposes.

A viscous liquid dispenser 10 according to the invention is illustrated generally in the figures. The dispenser 10 is illustrated and described herein as a liquid soap dispenser, which is a particularly useful embodiment of the present invention. However, it should be appreciated that the present invention is not limited to a dispenser for liquid soap, but has application in any environment wherein it is desired to dispense a metered amount of a viscous liquid from a dispensing unit.

The dispenser 10 includes a housing, generally 14. The housing 14 may contain side walls or members 16, a back side 18, and a front side 20. The housing 14 can take on any desired configuration and be formed from any number of components. In the illustrated embodiment, the housing 14 includes a front component 24 and a back component 22. The front and back components are separately manufactured and are permanently joined. It should be appreciated that the components may be manufactured from any desired material. In a preferred embodiment, the dispenser 10 is a disposable item and the housing 14 is molded from a relatively inexpensive plastic material. It may be desired that the back component 22 is molded from a clear or translucent plastic and includes side edges and alignment tabs that permit the back component 22 to fit into correspondingly sized recesses or other engaging structure defined in the side walls 16 of the front component 24. The back component 22 is permanently joined to the front component 24 by adhesives, welding, or any other relatively permanent attaching means.

The housing 14 defines an internal liquid reservoir 68 within the internal volume thereof. In the illustrated embodiment, the liquid reservoir 68 includes essentially the entire volume defined by the front component 24 and back component 22. Although not illustrated, it should be understood that any number of internal structural members, such as baffles or the like, may be included within the reservoir 68. It should be understood that the housing 14 thus also serves as a closed or sealed reservoir that cannot be opened by the maintenance technician. A desired amount of viscous liquid, for example soap, is preloaded into the housing 14 prior to the housing being delivered to its point of use.

Figure 8:
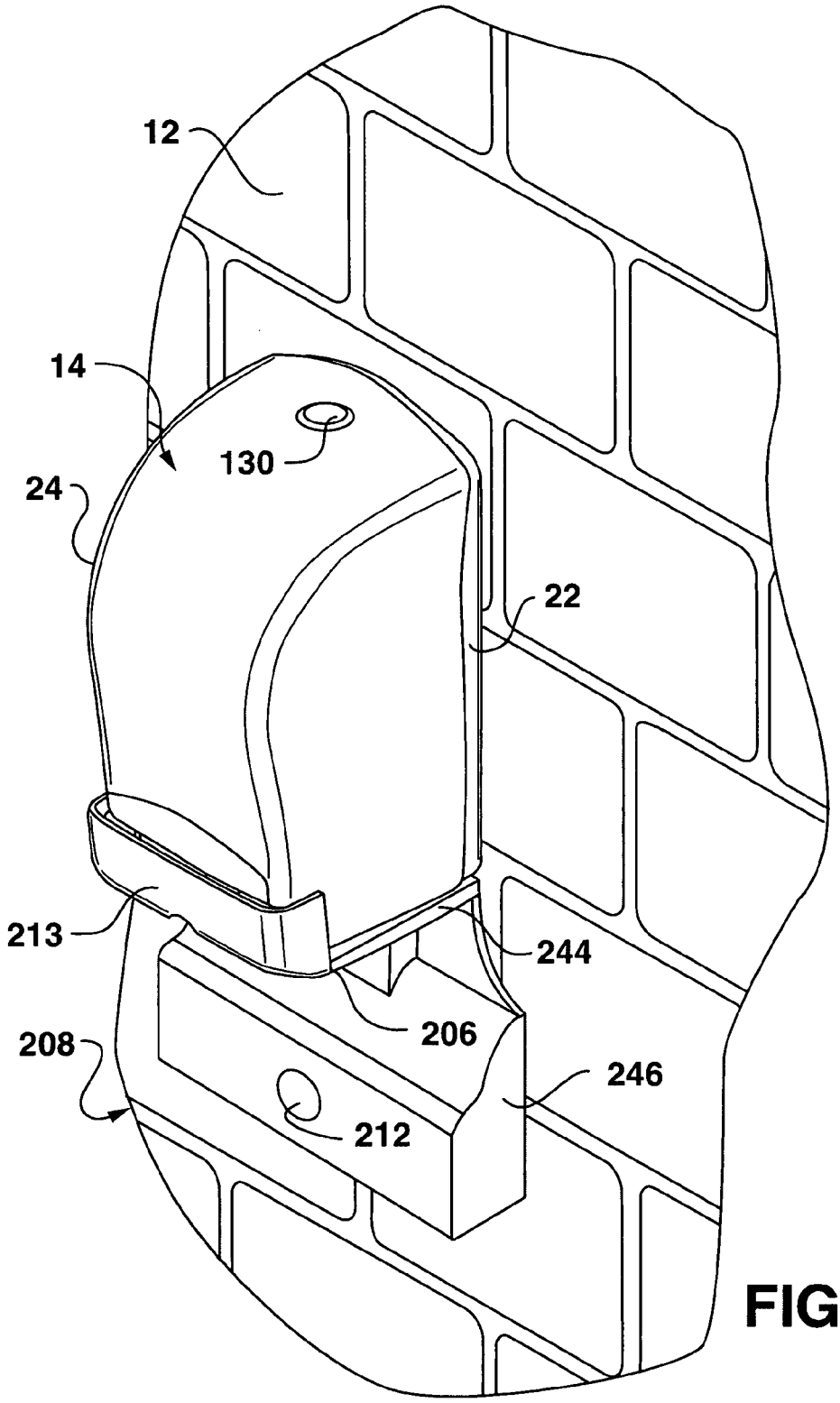
FIG. 8 is a perspective view of an alternate embodiment of a dispenser according to the invention wherein the housing is mounted directly to a supporting wall structure.

Applicants have found that it may be desired for the back component 22 of the housing 24 to be more rigid than the front component 24. One way of achieving this feature is to simply mold the back component 22 with a thickness greater than that of the front component 24. A more rigid back component 22 aids in mounting the housing 14 to an associated mounting assembly 200 (as with the embodiment of FIGS. 1 through 5), or directly to a supporting wall structure 12 (as with the embodiment of FIGS. 8 through 10). It has also been found that, if the front and back components are molded from a resilient plastic material, once the dispenser is empty, the back component 22 has enough "give" to enable the dispenser 10 to be easily removed from an associated mounting mechanism, for example a bracket 58 as described in greater detail below.

Before describing particular embodiments of electronic actuating mechanisms that may be used with dispensers 10 according to the invention, a description of various embodiments of pump mechanisms internal to the housing 14 will be helpful.

Figure 14:
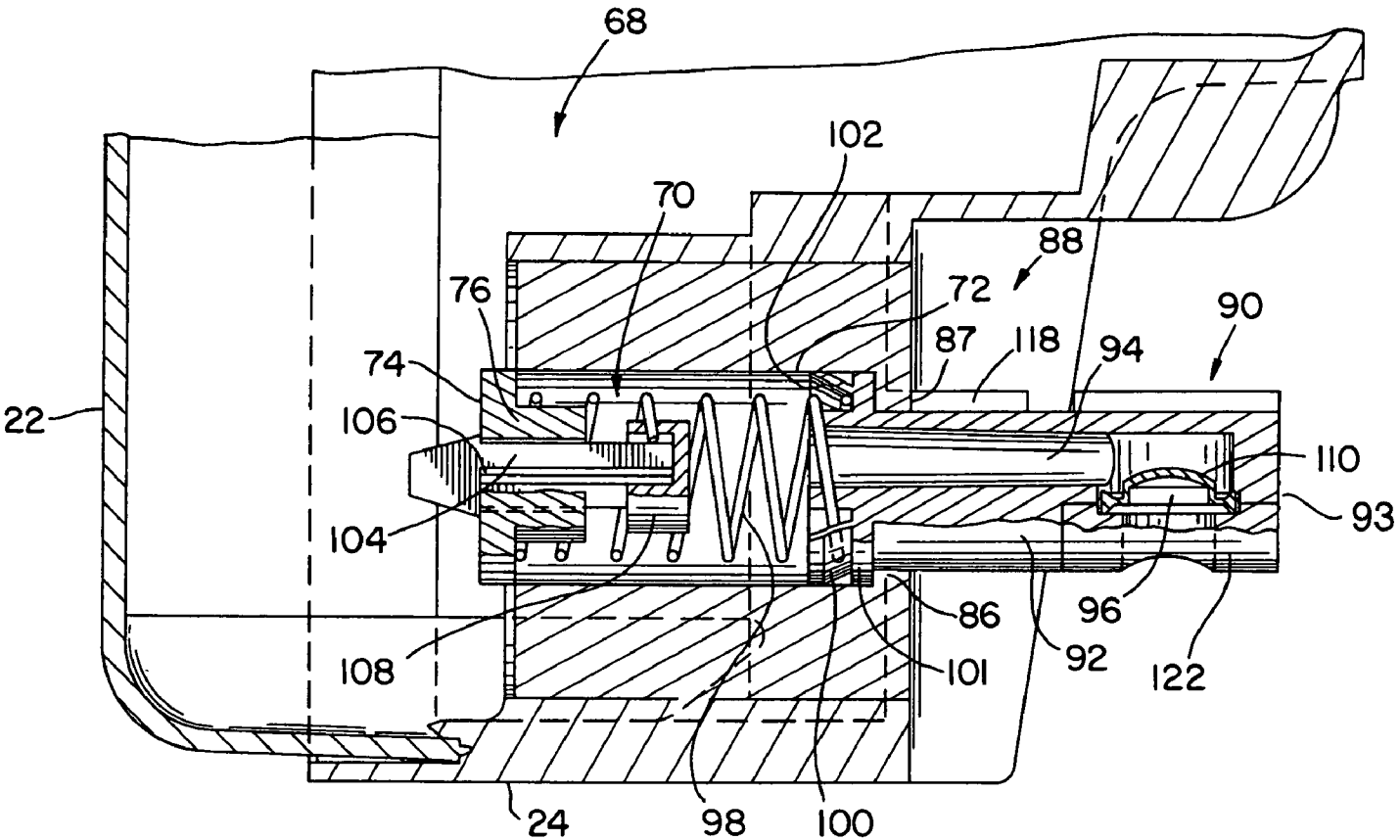
FIG. 14 is partial perspective and cut-away view of a pump mechanism embodiment that may be used with dispensers according to the invention.

Referring to FIG. 14, a dispensing pump mechanism, generally 88, is disposed at least partially within the reservoir 68. The pump mechanism 88 has a delivery end 90 that extends out of the housing or reservoir 68. The pump mechanism 88 is configured to dispense a metered amount of the viscous fluid upon a user actuating the pump mechanism. It should be appreciated that any number of conventional and well known pump devices may be configured for electronic actuation by a motor driven actuator and utilized in the dispenser 10. The pump mechanism 88 illustrated in the drawings is one embodiment of a suitable mechanism.

The pump mechanism 88 includes a cylinder 92 that is slidable within a chamber 70. The volume of chamber 70 determines the metered dose of liquid dispensed upon each actuation of the pump. The chamber 70 may be formed by any internal structure of the housing 14. It may be preferred that the chamber is defined by structure integrally molded with the front component 24 of the housing 14. In the illustrated embodiment, the chamber 70 is defined by chamber walls 72 as a generally cylindrical chamber. The cylinder 92 includes a channel 94 defined longitudinally therethrough. The channel 94 is in communication with the interior of the pump chamber 70 through an end wall of the cylinder. The delivery channel 94 terminates at a dispensing orifice 96 defined in the front end of the cylinder 92, the front end defining an end face 93.

The cylinder 92 sealingly engages against the chamber walls 72 by any conventional means. For example, a flange or piston 101 may be disposed at the rear end of the cylinder 92 for sealing engagement against chamber wall 72. In an alternative embodiment, O-rings may be provided around the piston 101. The piston 101 pressurizes the chamber 70 and ensures that the viscous liquid contained within the chamber is dispensed through the delivery channel 94 upon actuation of the cylinder 92 and does not simply move from one end of the pump chamber 70 to the other upon movement of the cylinder.

The pump cylinder 92 is biased within the chamber 70 by way of, for example, a spring 98. Other resilient devices, including a leaf spring, spring washer, and the like, may be utilized for this purpose. In the illustrated embodiment, the spring 92 is seated within a recess 102 defined by a flared flange 100, as particularly illustrated in FIG. 14. The opposite end of the spring 98 is fitted around a cylindrical extension 76 of an end cap 74. The end cap 74 is permanently fixed to the structure defining the pump chamber 70 after the cylinder 92 has been inserted into the pump chamber.

Figure 5:
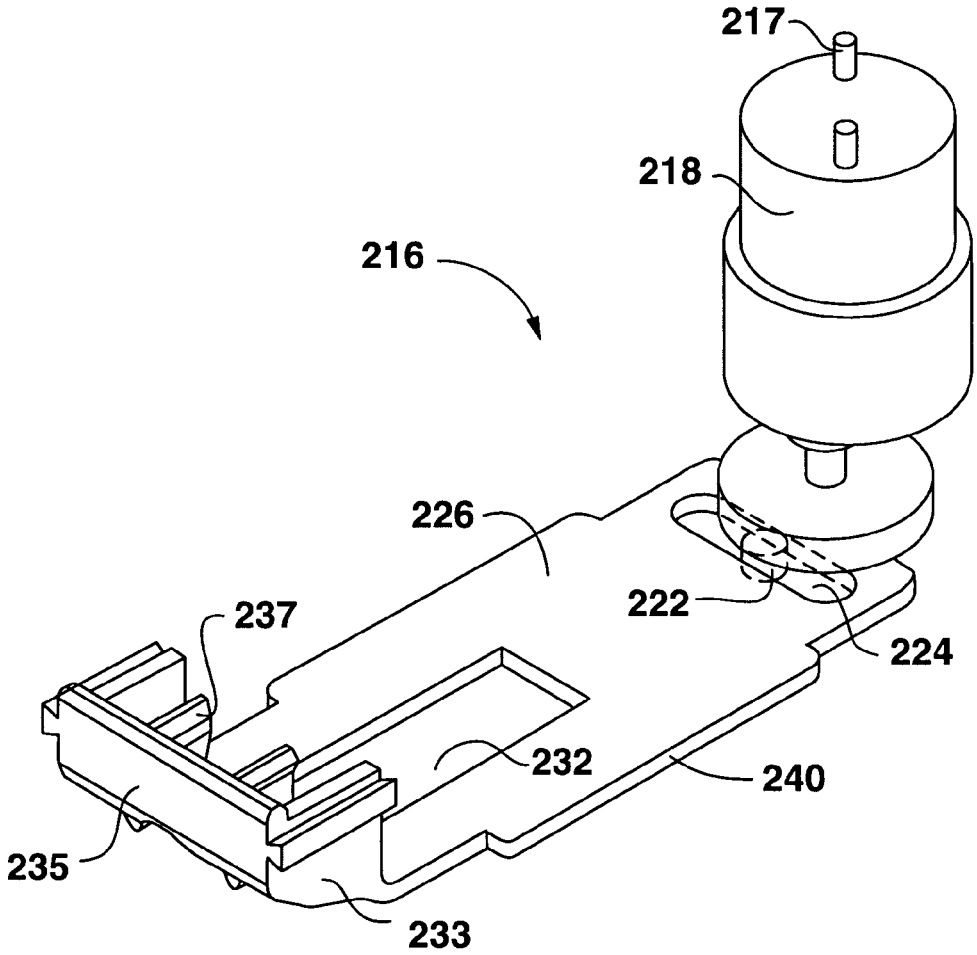
FIG. 5 is a perspective view of an embodiment of a motor driven actuator that may be used in dispenser embodiments according to the invention.

Structure is also provided to ensure that the cylinder 92 cannot be pulled from the front end of the chamber 70. In the illustrated embodiment, this structure corresponds to a flange portion of the front wall 86 of the chamber 70. As illustrated in FIG. 5, the flange portion 86 of the wall engages against the piston 101 of the pump cylinder 92.

Figure 7:
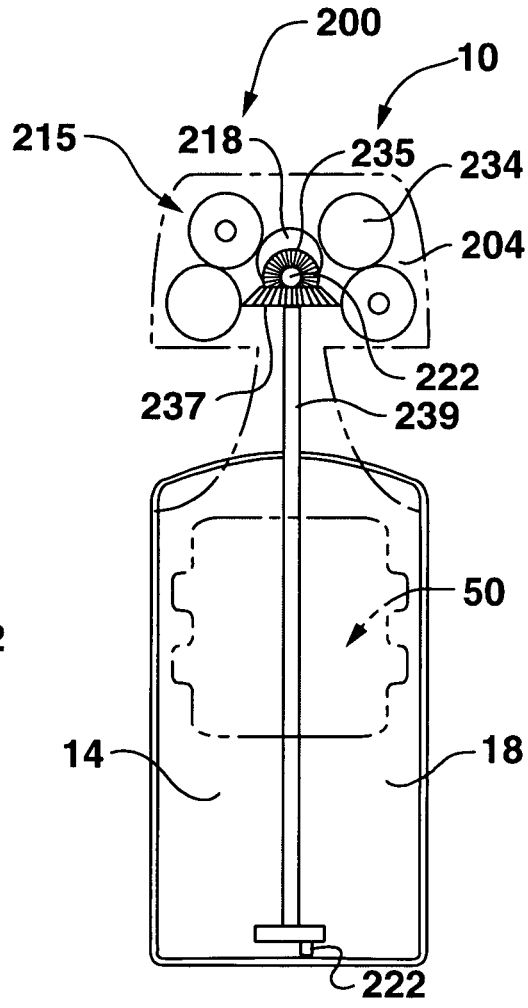
FIG. 7 is a back view shown in partial cut away of the dispenser of FIG. 6.

A check valve device 104 is configured with the pump mechanism 88 to ensure that the viscous liquid within the pump chamber 70 is not pushed out of the chamber 70 upon movement of the cylinder 92 within the chamber 70. In the illustrated embodiment, the check valve device 104 is a shuttle type check valve having radially extending arms 106. The shuttle valve is slidably disposed within an opening defined through the end cap 74. The space between the radial arms 106 is open to the reservoir 68 so that the liquid can flow from the reservoir 68 into the pump chamber 70 upon movement of the cylinder to the forward end of the pump chamber 70, as illustrated in FIG. 7. A cap 108 is provided on the forward end of the shuttle valve 104 disposed within the pump chamber 70 to ensure that the opening in the end cap 74 is sealed upon actuation of the pump. The cap 108 seals against the end face of the end cap 74.

To dispense a metered amount of the viscous liquid contained within the reservoir 68, the front face 93 of the cylinder 92 is engaged by a motor driven actuator, as described in greater detail below. The pump cylinder 92 is driven rearwardly within the pump chamber 70 by the motor driven actuator. Pressure of the viscous liquid within the chamber 70 forces the shuttle valve 104 to close and the viscous liquid contained within the chamber 70 is directed into the delivery channel 94 defined longitudinally within the pump cylinder 92, and is expelled through the dispensing orifice 96. Upon release from the motor driven actuator, the spring 98 forces the pump cylinder to return to the position illustrated in FIG. 14. This action unseats the shuttle valve 104 and draws viscous liquid back into the pump chamber 70.

So as not to draw a vacuum within the reservoir 68, the reservoir is vented. This venting may be accomplished by various means. For example, the reservoir 68 could be vented directly through or around the cylinder 92. However, this may not be a desired embodiment since fluid would tend to leak out from around the cylinder. One preferred venting method as illustrated in the figures is to vent the top of the housing 14, for example by way of a conventional vent valve 130 disposed through the top surface of the housing 14. Various embodiments of vent valves 130 are described in detail in the U.S. patents cited above and incorporated herein by reference.

FIG. 14 illustrates a locking characteristic of the pump cylinder 92 that is particularly useful during shipment of the housing 14. The pump cylinder 92 may include a longitudinal channel 118 defined in the top thereof. A tab portion 87 of the pump chamber front wall member 86 is disposed within the longitudinal channel 118. In this way, the pump cylinder 92 is prevented from rotating upon actuation and release thereof. A partial circumferential channel (not visible in FIG. 14) is defined in the pump cylinder 92 at a location corresponding to the completely depressed or actuated position of the cylinder 92 within the chamber 70. For shipment of the housings 14, the pump cylinder 92 may be depressed and then rotated so that the tab 87 is engaged within the circumferential channel. In this configuration, the pump cylinder 92 is locked in position and cannot move within the chamber 70 until the pump cylinder is rotated back into the position illustrated in FIG. 14. This procedure would be accomplished by the maintenance technician prior to mounting the housing 14 to the mounting assembly 200 or onto the supporting wall surface 12.

Figure 15:
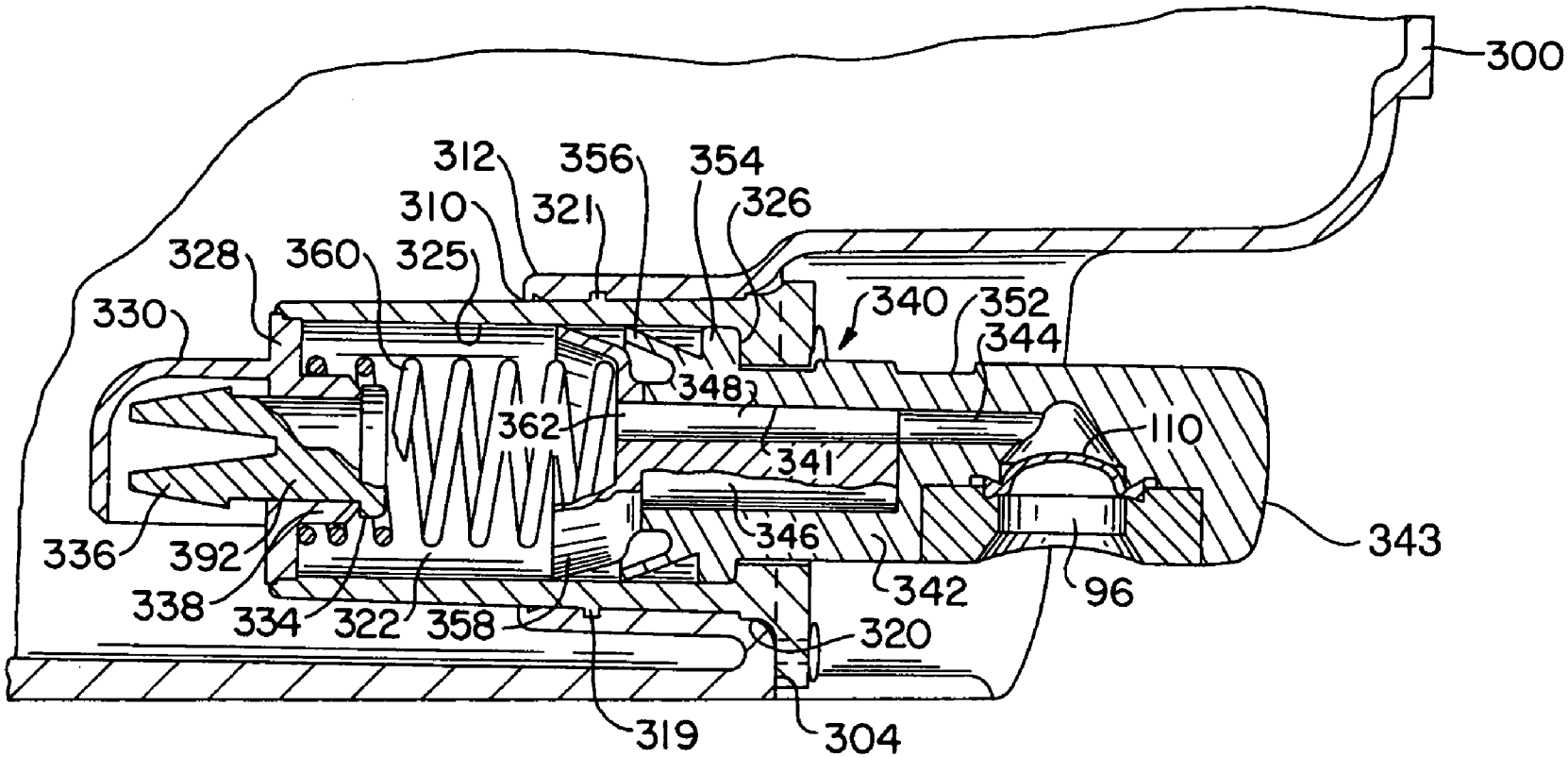
FIG. 15 is a partial perspective and cut-away view of an alternate pump mechanism configuration.
Figure 16:
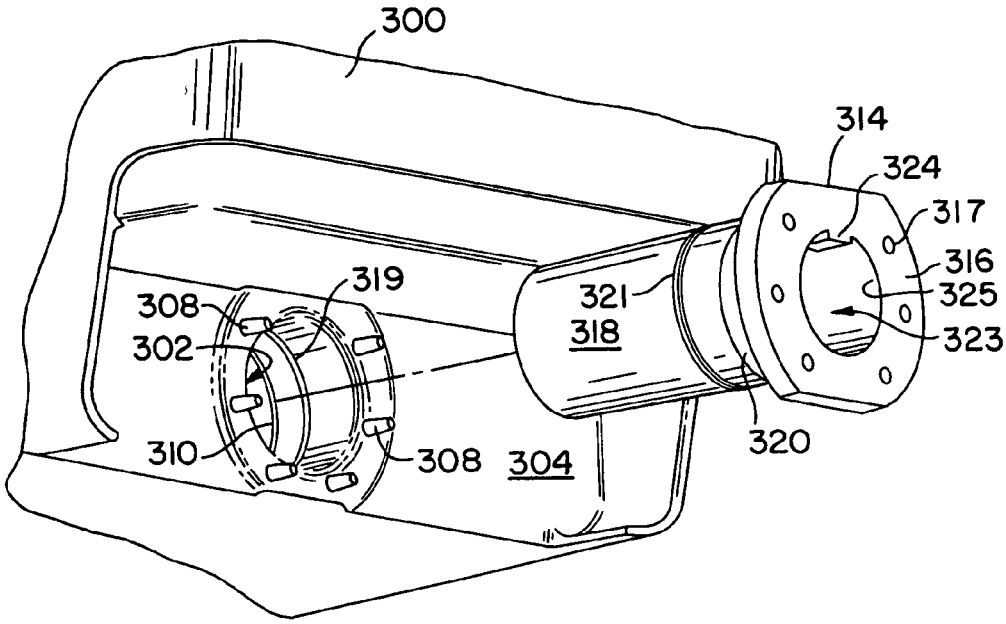
FIG. 16 is a perspective component view of the pump chamber insert used with the pump mechanism of FIG. 15.
Figure 17:
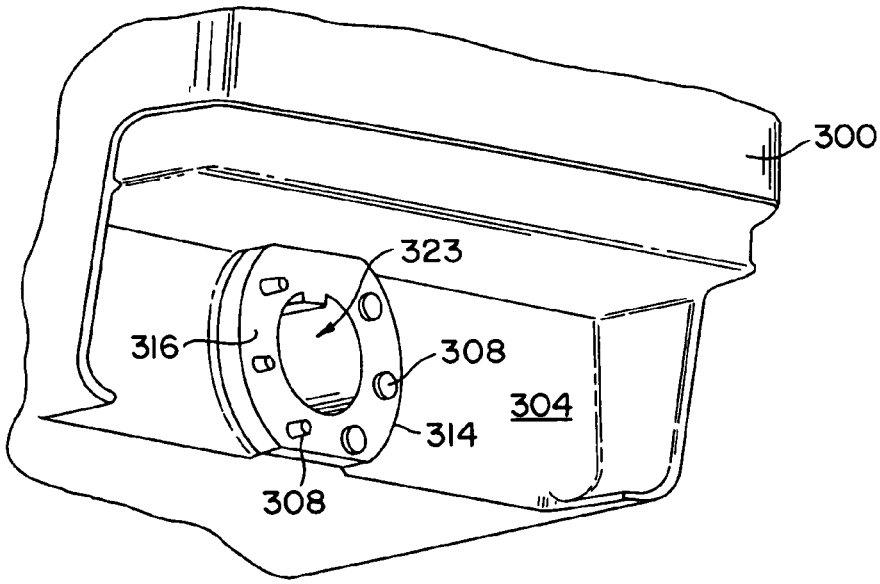
FIG. 17 is a front perspective view illustrating the pump chamber insert after insertion into the housing.

It may be desired to include a valve mechanism within the dispensing orifice 96 of the pump cylinder 92 to prevent leakage of viscous liquid or soap from the dispenser. Any manner of sealing valve may be utilized in this regard. Applicants have found that a particularly useful valve mechanism 110 is the type of valve illustrated in FIGS. 14 and 15. This valve 110 includes a flange member 113 used to seat the valve 110 within the delivery end of the pump cylinder 92. The valve includes at least one, and preferably a plurality, of resilient flaps 112 defining an opening 114 therethrough. The flaps 112 seal against themselves when the valve 110 is positioned within the pump cylinder 92 in the orientation illustrated in FIGS. 14 and 15. Upon actuation of the pump cylinder 92, liquid pressure forces the resilient flaps 112 to open to dispense the liquid from the pump cylinder 92. A separate cap member 122 may be used to secure the valve 110 in position with respect to the dispensing orifice 96, the cap member 122 including its own opening aligned with the dispensing orifice. The cap member 122 may comprise a press fit element or may be permanently adhered, welded, etc., to the pump cylinder 92.

The valve 110 also tends to vent the pump chamber 70 as the cylinder 92 moves back to its rest position after being actuated. As a vacuum is drawn in the chamber 70, the resilient flaps separate slightly and are drawn towards the chamber 70 thus defining a vent path. Once the chamber is vented, the flaps close and seal against each other.

The valve 110 illustrated in the figures is conventionally known in the art as a bifurcating valve and may be obtained from LMS Corporation of Michigan, USA.

It may also be desired to provide means for the maintenance technician to determine the level of viscous liquid within the housing 14. In this regard, as discussed above, a portion of the housing 14 may be formed from a translucent or clear material. For example, the entire back component 22 may be formed from a translucent or clear material so that the service or maintenance technician can view the remaining liquid level from the side of the dispenser. In an alternative embodiment, a window 136 of clear or translucent material may be provide anywhere in the housing 14, preferably near the bottom portion of the housing, to provide the maintenance technician with the capability of viewing inside the reservoir to determine the remaining amount of liquid therein.

An alternative suitable pump mechanism for use in a dispenser according to the invention may include a self-contained device having a pump chamber housing that is fitted into a bore defined through a front wall surface of the housing so as to be in communication with the internal reservoir. Such an embodiment is illustrated in FIGS. 15 through 19. This embodiment is similar in many aspects to the embodiment of FIG. 14 and, thus, the common features need not be described in detail.

Referring to FIGS. 15 through 19, in this embodiment the housing 300 includes a bore 302 defined through a front surface 304. A generally cylindrical extension 312 may extend rearwardly from the front surface 304 into the reservoir. The extreme end of the cylinder extension 312 has a radially inward extending seal 310. As will be described in greater detail below, seal 310 seals against a chamber insert member. A circumferential recess or groove 319 may also be defined in the extension 312. A plurality of nubs or protrusions 308 extend from the front surface 304 and surround the bore 302. The cylindrical extension 312, ring seal 310, groove 319, and protrusions 308 may all be molded integrally with housing 300.

A chamber insert 314 is designed to fit through the bore 302. The insert 314 is shown particularly in FIGS. 19 and 21 and may be a generally cylindrical member having an interior wall 325 defining an internal pump chamber 322. An opening 323 is defined through the forward end of the insert 314 through which a pump cylinder slides, as described below. The insert 314 includes a front outer flange 316 having a plurality of counter-bored holes 317 defined therethrough. The holes 317 align with the protrusions 308. The insert 314 is fitted through the bore 302 from the front side of the housing 300. The back side of the flange 316 is pressed against the front surface 304 of the housing 300 and the protrusions 308 extend through the holes 317. The insert is permanently attached to the housing 300 by melting the protrusions 308 in a "heat stake" process so that the molten material flows into the counter-bored holes 317 and thus anchors the insert 314 upon hardening. It should be appreciated that many other suitable devices and methods could be used to anchor or secure the insert 314 relative to the housing 300, including adhesives, welding, etc.

The insert 314 has an outer circumferential surface 318 that, when slid through the bore 302 and cylindrical extension 312, is tightly engaged by the seal 310 at the end of the extension 312. Thus, a first seal between the insert 314 and housing 24 is formed in this way. A ring-like protrusion 321 may be formed or otherwise provided around the surface 318 that engages in the groove 319 to give a positive indication that the insert 314 has been properly inserted. The ring 321 may be an O-ring and thus also provide a sealing capacity.

The insert 314 includes a radially outward extending portion 320 defined rearward of the back side of the outer flange 316. This portion 320 acts as a seal against the cylindrical extension 312. Thus, a second seal between the insert 314 and housing 24 is formed in this way.

The insert 314 includes an inner flange 326 defining the diameter of the opening 323, and an alignment tab 324 formed in the chamber 322. This tab 324 cooperates with a longitudinally extending channel or groove defined in the pump cylinder, as described below.

Figure 18:
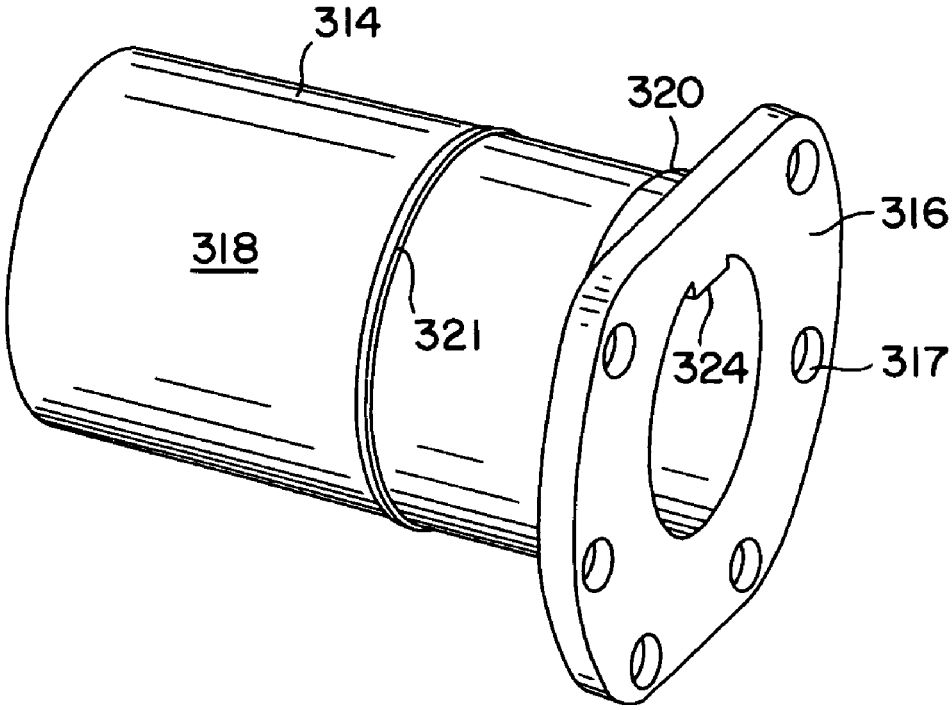
FIG. 18 is a detailed perspective view of the pump chamber insert.

The alternate embodiment of a pump cylinder used in the embodiment of FIGS. 15 through 19 includes a two-part pump cylinder 340. The first component 342 is a generally cylindrical member having a channel 344 defined therethrough that terminates at a dispensing orifice 96 defined in the front end of the first component 342. The front end of the first component 342 thus corresponds to the delivery end of the pump cylinder 340 and includes an end face 343 that is engaged by the motor driven actuator. A flange 354 is provided at the rearward end of the first component 342 to prevent the pump cylinder 340 from being pulled out of the pump chamber 322. This flange 354 engages against the inner flange 326 of the insert 314 in the fully extended position of the pump cylinder 340, as illustrated in FIG. 18.

As with the embodiment of FIG. 14, a locking feature is provided for the pump cylinder 349. A longitudinal groove or channel (not visible in the figures) is defined along the top outer surface of the first component 342 and is engaged by the alignment tab 324 of the insert 314 as the cylinder is slid longitudinally within the pump chamber 322. In this way, the pump cylinder 340 is prevented from rotating upon actuation and release thereof. A partial circumferential groove 352 is defined in the outer surface of the first component 342, as particularly illustrated in FIG. 18. The circumferential groove 352 is defined at a location corresponding to the pressurization position of the pump cylinder 340 within the pump chamber 322. For shipment of the dispenser, the pump cylinder 340 may be depressed and then rotated so that the tab 324 is engaged within the circumferential groove 352. In this configuration, the pump cylinder 340 is locked in the pressurization position and cannot move within the pump chamber 322 until the pump cylinder is rotated back into position so that the tab 324 is engaged within the longitudinal groove 350.

The first component 342 of the pump cylinder 340 also includes a flange seal 356 defined at the rearward end thereof. The flange seal 356 engages against the interior wall 325 of the insert 314 and ensures that the viscous liquid contained within the chamber 322 is pressurized and dispensed through the pump cylinder 340 upon movement of the cylinder from its rest position to the pressurization position and does not simply move from one end of the pump chamber to the other upon movement of the cylinder.

Figure 19:
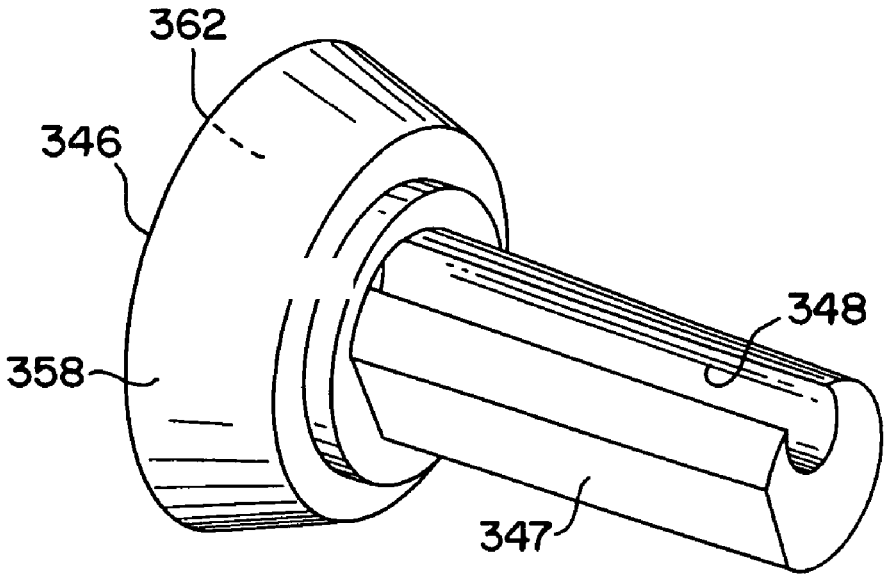
FIG. 19 is a detailed perspective view of a suitable pump cylinder.

The second component of the pump cylinder 340 may be a plug member 346 having a generally cylindrical extension 347 that is fitted into a chamber 341 defined in the rearward end of the first component 342. The plug member 346 has a channel 348 defined therethrough that axially aligns with the channel 344 defined in the first component 342. The aligned channels 344 and 348 thus define the delivery channel through the pump cylinder 340. As shown in FIG. 19, the channel 348 may be open along the top thereof wherein a closed channel is formed by cooperation of the first component wall defining the chamber 341 and the open channel 348. A cup-shaped flange member 358 is defined at the rearward end of the plug member 346. The side wall of the flange member 358 engages against the interior wall 325 of the insert 314 and thus defines a second flange seal between the pump cylinder 340 and the pump chamber 322. The interior of the cup-shaped flange member 358 defines a recess or seat 362 against which a spring sits, as described below.

As with the embodiment of FIG. 14, a check valve is provided with the pump chamber 322 to ensure that the viscous liquid within the chamber 322 is not pushed out of the chamber upon movement of the pump cylinder 340 within the chamber. The check valve in this embodiment is a shuttle valve 392 having radially extending and spaced apart arms 336. The shuttle valve 392 is slidably disposed within an opening defined through an end cap 328. The space between the radial arms 336 is open to the reservoir so that liquid can flow from the reservoir into the pump chamber 322 upon movement of the pump cylinder 340 to the forward end of the pump chamber 322. A sealing cap 334, such as an elastomeric cap, is provided on the forward end of the shuttle valve 392 to ensure that the opening in the end cap 328 is sealed upon actuation of the pump and rearward movement of the pump cylinder 340 within the chamber 322 to its pressurization position. The cap 334 seals against the forward end of a cylindrical extension 338 of the end cap 328. An open cage member 330 extends from the end cap 328 into the reservoir and surrounds the radial arms 336.

The pump cylinder 340 is biased with the pump chamber 322 to its rest position by way of a spring 360. Other types of resilient devices, such as a leaf spring, spring washer, and the like, may be utilized for this purpose. The spring 360 has a forward end seated in the recess 362 of the cup-shaped flange member 357 of the plug member 346. The opposite end of the spring 360 is fitted around the cylindrical extension 338 of the end cap 328.

The end cap 328 is permanently fixed (i.e., by welding, adhesive, etc.) to the rearward end of the chamber insert 314 after the pump cylinder 340 and spring 360 are inserted into the insert from its rearward end.

Operation of the embodiment depicted in FIGS. 18 through 22 is substantially the same as described above with respect to the embodiment of FIG. 14.

The pump mechanism of FIGS. 15 through 19 may be desirable from a manufacturing and assembly standpoint. It may also be desirable to be able to remove the pump mechanism from the housing and recycle or reuse all or part of the pump mechanism. In this case, it might be preferred to provide a more readily "breakable" or disconnectable attachment between the chamber insert 314 and the housing 24, such as a releasable adhesive, mechanical fastener (i.e., threaded connection), etc.

Figure 4:
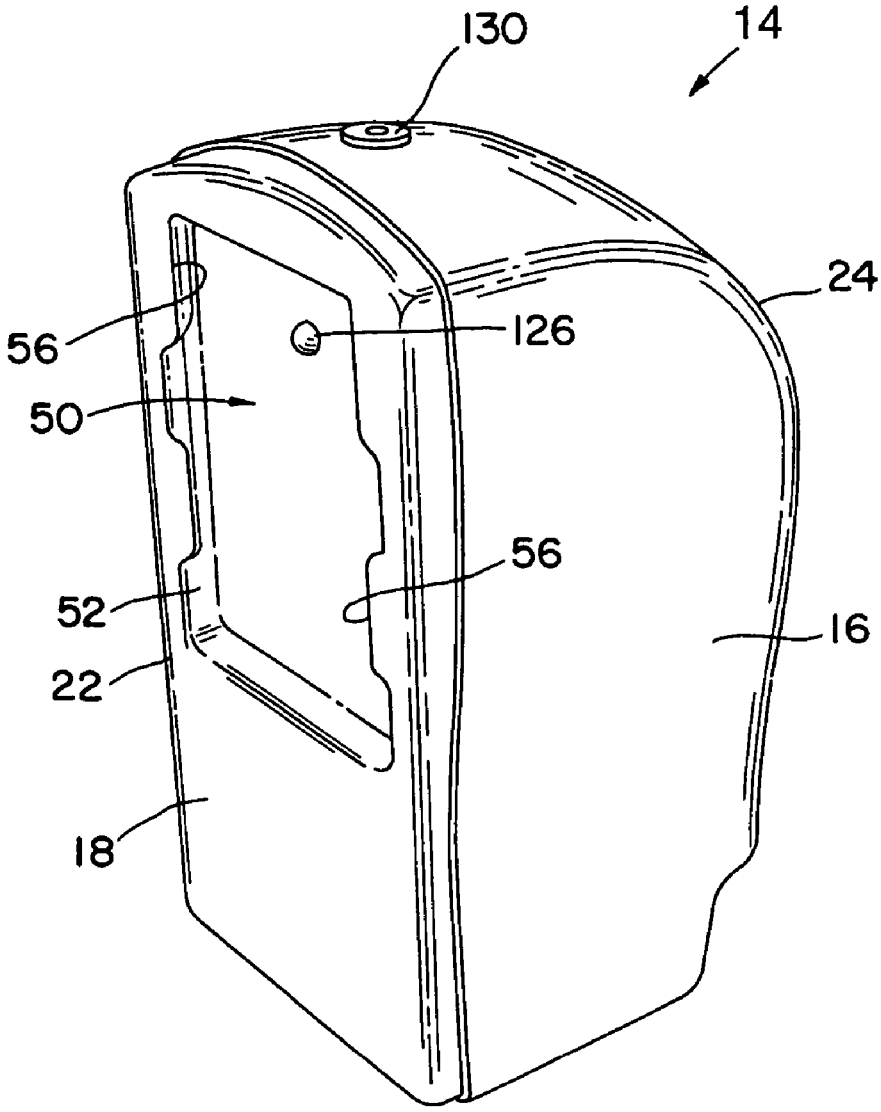
FIG. 4 is a perspective back view of a housing member that may be used with various embodiments according to the invention.
Figure 9:
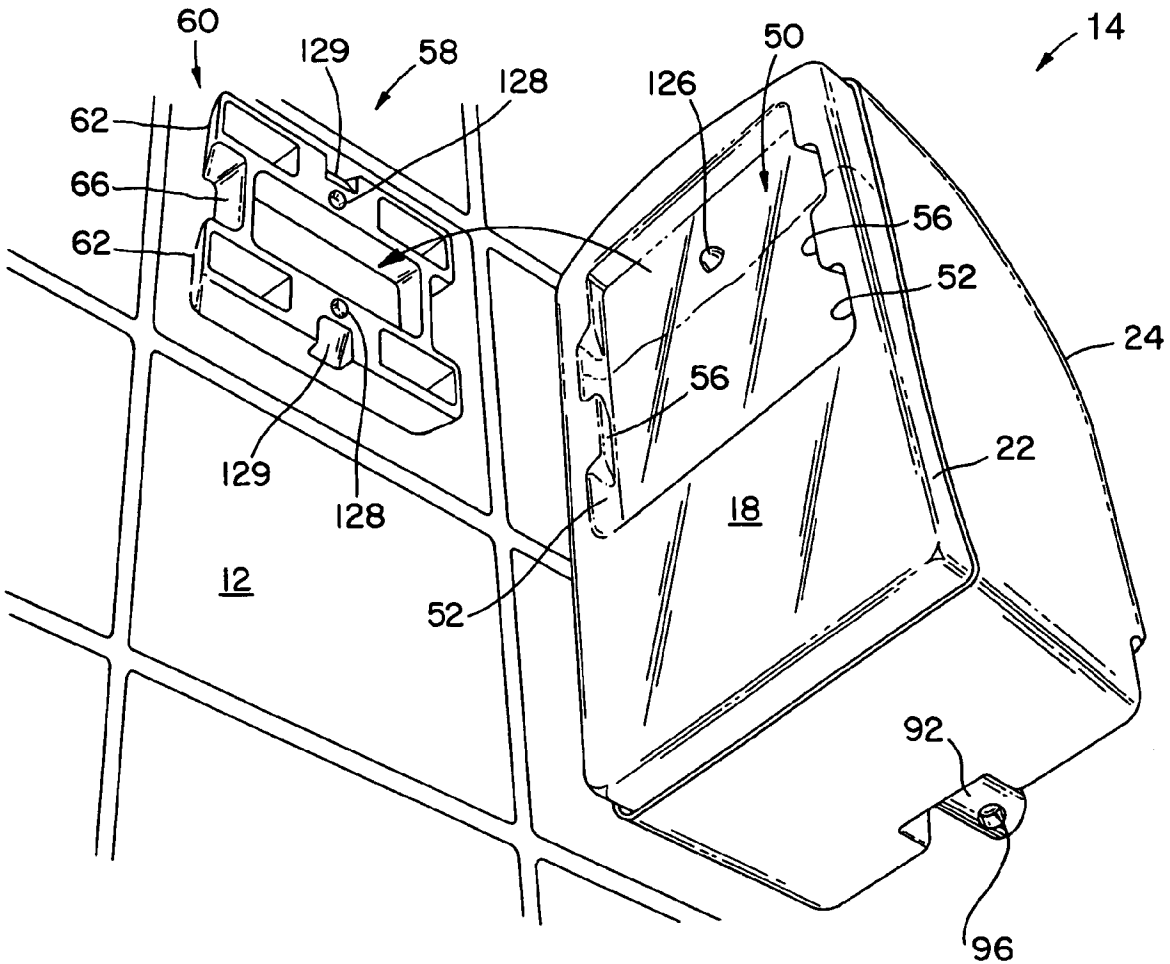
FIG. 9 is a perspective view of the housing unit used in the embodiment of FIG. 8.

The housing 14 also may include a mounting mechanism that allows the housing to be detachably connected with complimentary mounting structure, for example bracket 58, provided on a wall surface 12 (FIGS. 8 and 9) or with the mounting assembly 200 (FIGS. 1 through 4). Referring to FIGS. 4 and 9, in one embodiment according to the invention, the mounting mechanism includes an integrally molded feature of the back side 18 of the housing 14. For example, a recess 50 is molded into the back side 18 and is defined by generally vertical side walls 52. Engaging structure is provided along the side walls 52 for engaging against or with complimentary structure provided on the mounting bracket 58, as discussed in greater detail below. In the illustrated embodiment, the engaging structure is defined by angled surfaces 56 defined along the vertical walls 52. The angled surfaces 56 engage against complimentary angled surfaces 62 defined on the bracket 58, as can be particularly seen in FIG. 9. In the illustrated embodiment, at least two angled surfaces 56 are provided and are separated by a section of vertical wall 52. The two angled surfaces 56 engage against angled surfaces 62 of the bracket 58. In order to attach the housing 14 to the bracket 58, the maintenance technician simply positions the housing 14 against the bracket 58 such that the angled surfaces 56 are vertically disposed between the corresponding angled surfaces 62 of the bracket. Then, the housing 14 is simply slid in a vertical direction so that the angled surfaces 56, 62 engage. In this interlocking configuration, the housing 14 cannot be pulled away from the bracket 58. The double angled surface 56 configuration provided on each vertical wall 52 is particularly useful in that it provides an increased interlocking surface area of angled surfaces with relatively little vertical movement required between the housing 14 and the bracket 58 as compared to a single angled surface 56 having the same longitudinal surface area.

It is desirable to include a securing device to indicate to the technician that the housing 14 has been properly positioned and to prevent removal of the housing 14 without a concerted effort. In the embodiment illustrated, the securing device comprises a protrusion 126 extending from the back side 18 of the housing within the recess 50. The protrusion 126 slides up a ramp surface 129 defined in the bracket 58 and snaps into a correspondingly sized divot 128 disposed adjacent to the ramp surface 129.

It should appreciated that various embodiments of releasable interlocking structure may be provided between the housing 14 and supporting wall surface 12 or mounting assembly 200, and that the bracket 58 and engaging recess 50 are presented by way of example only. For example, relatively simple bayonet type fasteners, spring loaded latches, and the like, may be provided in this regard. A desirable feature of the invention is that the entire housing 14 is disposable and, thus, relatively simple yet reliable engagement devices are preferred.

Depending on the particular embodiment of the dispenser 10, the mounting structure, for example the bracket 58, may be mounted by various conventional means. For example, if mounted directly to the supporting wall surface 12 as in the embodiment of FIGS. 8 and 9, the structure 58 may be affixed to the wall 12 by screws, adhesive, and so forth. If included as a component of the separate mounting assembly 200, as in the embodiment of FIGS. 1 through 4, the structure 58 may be affixed with adhesive, mechanical fasteners, and so forth, to the appropriate surface of the mounting assembly 200, as described in greater detail below.

Figure 2:
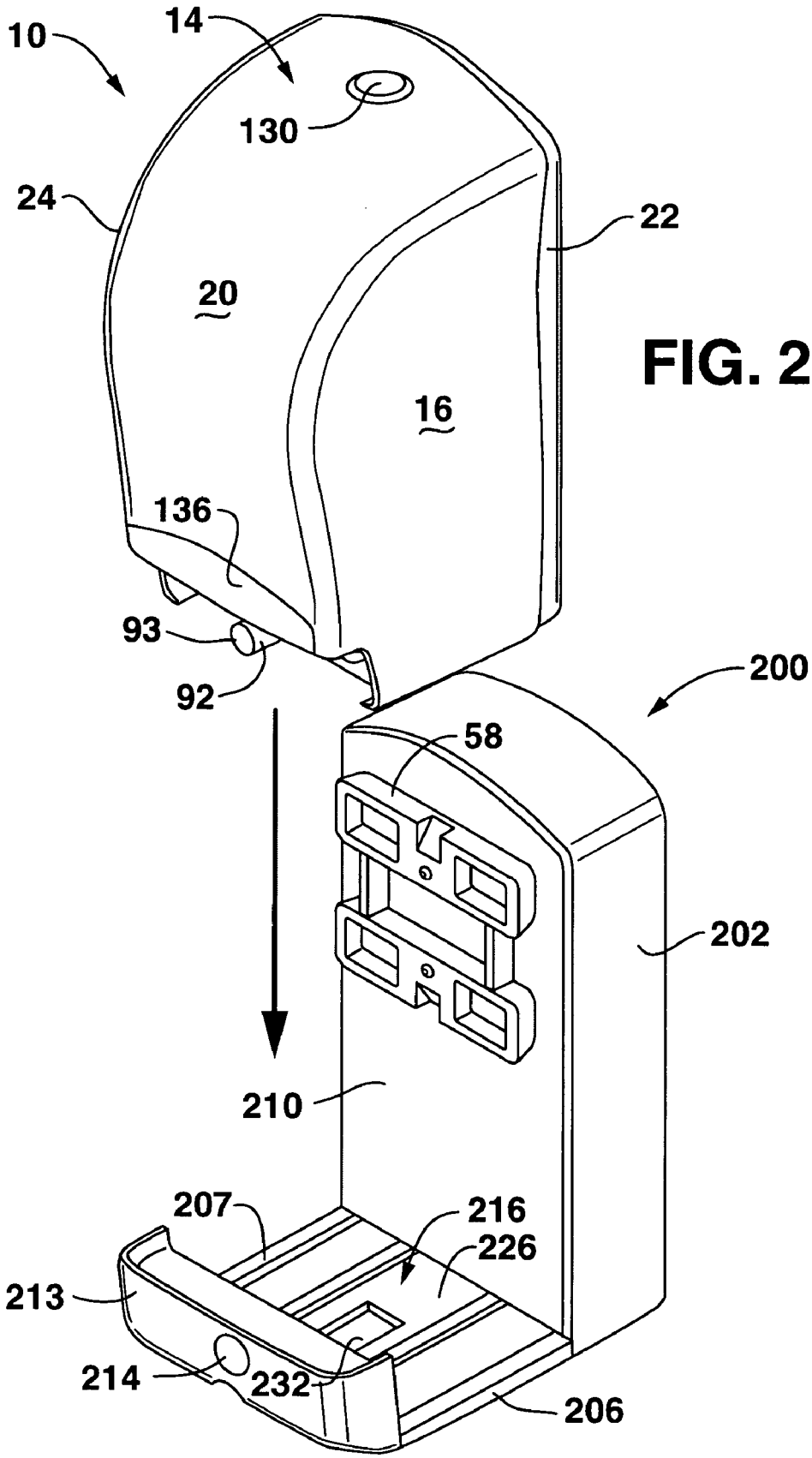
FIG. 2 is a perspective view of the dispenser of FIG. 1 particularly illustrating the removable housing.
Figure 3:
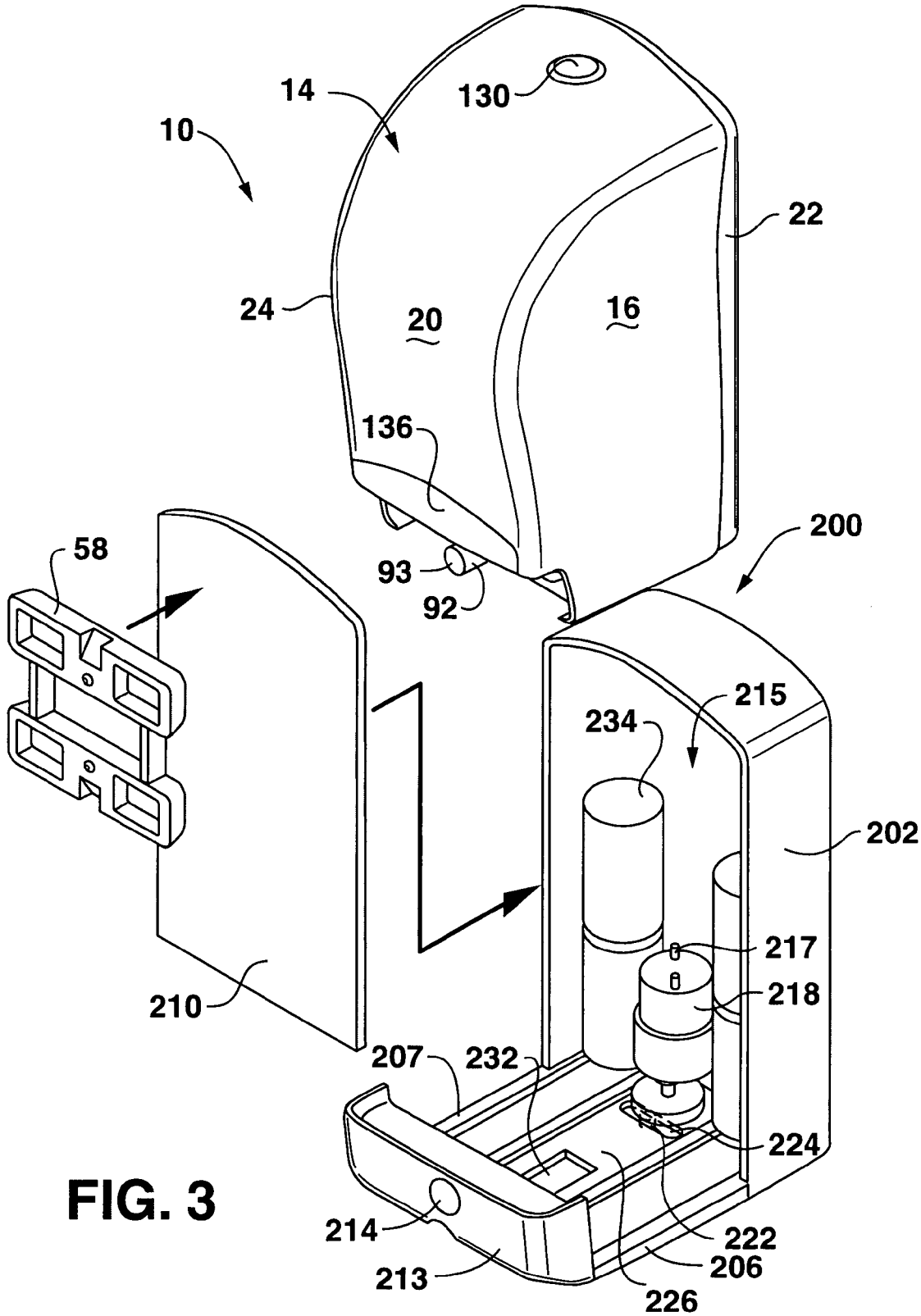
FIG. 3 is a perspective component view of the dispenser according to FIG. 1.

As mentioned, in certain embodiments, a mounting assembly is separately affixed to a supporting wall structure, and the housing is releasably attached to the mounting assembly. Referring to FIGS. 1 through 4, in the illustrated embodiment, the mounting assembly 200 includes an enclosed back unit 202 that is mountable against the supporting wall structure 12 by any conventional means, such as screws, adhesives, and the like. As described in greater detail below, various components of the electronic actuating mechanism may be housed in the back unit 202. As seen in FIG. 2, the back unit 202 may include a wall 210 to which is attached the bracket 58. The housing 14 is attachable to the bracket 58, as described above, such that the back 18 of the housing 14 is flush against the wall 210, as in the configuration of FIG. 1. The bracket 58 may be mounted to the wall 210, or formed integrally therewith.

In an alternate embodiment, the mounting assembly 200 may be attachable to a bracket 58 that has been separately attached to a supporting wall 12. In this embodiment, the back unit 202 of the mounting assembly 200 may include a recess formed in a back wall thereof for engagement with the bracket 58.

The mounting assembly 200 may also include a base unit 206 that can be attached to, or formed integral with, the back unit 202. The base unit 206 is disposed under the housing 14 and may support a portion of the weight of the housing. For example, the housing 14 may rest at least partially on support members 207 once attached to the back unit 202, as seen in FIG. 1. Alternately, the housing 14 may be supported entirely on the wall 210 above the base unit 206. The base unit 206 may include an upturned front member 213 that covers the exposed pump cylinder 92 and other components of the actuator, and provides an overall aesthetically pleasing profile to the combined housing 14 and mounting assembly 200, as particularly seen in FIG. 1.

Figure 6:
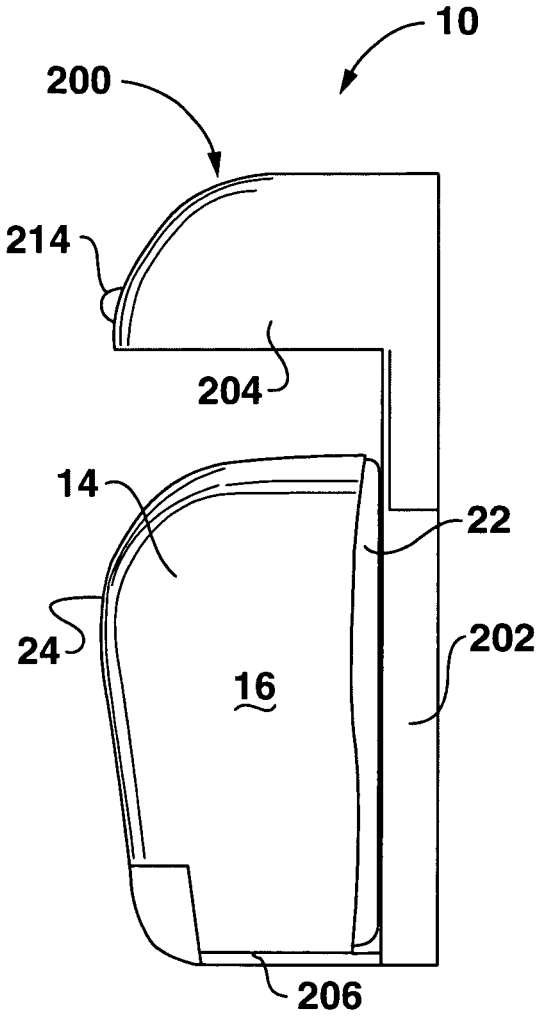
FIG. 6 is a side view of an alternate dispenser configuration according to the invention.

In an alternate embodiment illustrated for example in FIGS. 6 and 7, the mounting assembly 200 may include an enclosed top unit 204 that is disposed above the housing 14. The motor, power supply, and control circuitry for the electronic actuating mechanism may all be housed within the top unit 204. This assembly 200 may also include a back unit 202 to which the housing 14 is mounted. The back unit 202 need not have a substantial depth relative to a supporting wall since the majority of the components of the electronic actuating mechanism are contained in the top unit 204. This embodiment would also incorporate a base unit, such as the base unit 206 of the embodiment of FIGS. 1 through 3.

An electronic actuating mechanism, generally 15, is provided to drive the pump mechanism 88. As mentioned, the electronic actuating mechanism 15 may be housed in one of the units of the mounting assembly. The mechanism 15 includes a motor driven actuator 216 that engages with the pump mechanism 88 upon insertion of the housing 14 into the mounting assembly 200. A motor 218, such as a DC motor, and associated power supply circuitry are also carried by the mounting assembly 200. The motor 218 is in driving engagement with a motor driven actuator 216. Power for the motor 18 and associated circuitry may be supplied by one or more replaceable batteries 234 also carried by the mounting assembly, or may be a direct hard-wire supply, for example DC current converted from a building's AC system. For sake of clarity, the wiring and circuitry components are not illustrated in the various views of the dispenser. For example, wire and connections between the battery supply 234 and motor leads 217 are not particularly illustrated. Such connections are, however, a matter of simple design choice for those skilled in the art and need not be described in detail herein.

In the illustrated embodiments, the motor driven actuator 216 includes a member that is slidable in a horizontal path to engage and move the pump cylinder 92 to a dispensing position within the pump chamber. The cylinder 92 need not be engaged by the actuator 216 as it returns to its rest position. For example, the cylinder 92 may return to its rest position by an internal pump spring 98, as described above with respect to FIG. 14. The delivery end of the pump cylinder 92 extends out of the front end of the pump chamber 70 and includes a front face 93 that is engaged by the motor driven actuator 216.

Motive force from the motor 218 may be transferred to the actuator 216 in any number of suitable embodiments. In the illustrated embodiments, the motor 218 includes an off-center drive cam 222 engaged within an elongated cam surface 224, such as an elongated slot, defined in the motor driven actuator 216. This eccentric or off-center cam arrangement converts rotational movement of the motor shaft to linear movement of the motor driven actuator 216, which in turn engages and moves the pump cylinder 92 in a linear path from its rest position to a dispensing position wherein a metered dose of the viscous liquid is expelled from the pump chamber 70.

Figure 10:
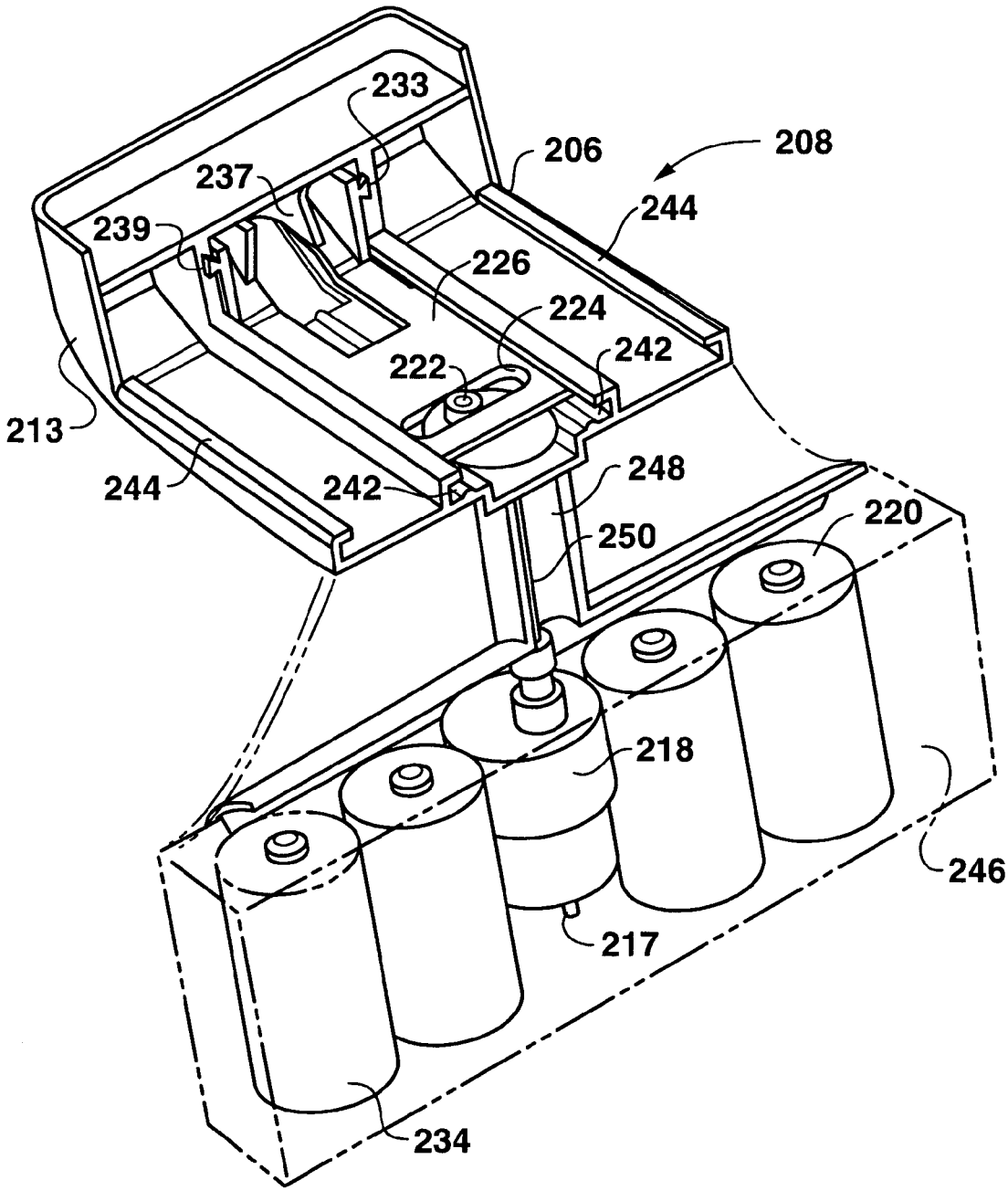
FIG. 10 is a perspective and partial cut-away view of the base unit used in the embodiment of FIG. 8.

As seen in FIGS. 5 and 10, the motor driven actuator 216 may be an elongated plate member 226 having side edges 240 that are slidably supported in channels 242 defined by structure in the mounting assembly 220, such as the base unit 206. The plate member 226 may have a front end 235 or other surface that engages with the front face 93 of the pump cylinder 92 upon mounting the housing relative to the mounting assembly 200. Operation of the actuator 216 is hidden from view by the upturned wall 213 of the base unit 206. An opening 232 (i.e., an elongated slot) may be defined in the plate member 226 proximate to the front end that is aligned with the delivery end of the pump cylinder 92 such that the metered dose of liquid is dispensed through the opening 232.

Still referring to FIGS. 5 and 10, the actuator 216 may include additional guide members 233 disposed generally at the front end thereof that engage within slots 239 provided in the front end of the mounting assembly base unit 206. The actuator 216 may also include spaced apart flanges 237 that engage along either side of the portion of the pump cylinder 92 that extends out of the housing 14 to add additional support and guidance.

Operation of the electronic actuating mechanism 215 may be initiated manually or automatically. For example, for manual actuation, a push-button 212 or similar device may be provided with the mounting assembly 200 wherein a user initiates a dispensing sequence by manually pushing the button 212 or otherwise actuating the manual device. This manual actuation in turn results in an electronic motor driven dispensing cycle as described above. In an alternate embodiment, a sensor 214 may be provided and integrated with the control circuitry for automatic initiation of the dispensing sequence. The sensor 214 may be, for example, a heat sensor, motion sensor, or any one or combination of sensors widely known and used for detecting the presence of a person in relatively close proximity to the dispenser 10. Aspects of a suitable control circuit are described in greater detail below.

As described, in the embodiment of FIGS. 6 and 7, the motor 218, battery power supply 234, and associated control circuitry are housed in the top unit 204. Motive force from the motor 218 may be transferred to the motor driven actuator 216 in the base unit 206 by any suitable gearing arrangement. For example a gear 235 may be supplied on the motor shaft that is in turn engaged with a bevel gear 237. A shaft 239 may extend from below the bevel gear 237, through the back unit 202, and have an end with an off-set drive cam 222 engaged with a cam surface (e.g., an elongated slot) defined in the motor driven actuator (not visible in FIGS. 6 and 7) such that the actuator is driven as described above with respect to FIGS. 1 through 5.

In an alternate embodiment of a dispenser 10 according to the invention, the housing 14 is mounted directly to the supporting wall structure 12, as seen in FIGS. 9 and 10. A separate drive module 208 is affixed to the wall structure 12 below the bracket 58 and includes a motor driven actuator 216, as described above. The drive module 208 includes an enclosed housing 246 that contains the motor 218, power supply 234, and associated control circuitry. The automatic sensor 212 may also be provided with the enclosed housing 246. The drive module 208 may include a base unit 206 as described above with respect to the other embodiments. Motive force from the motor 218 is transferred to the offset drive cam 222 engaged in the cam surface 224 by way of the elongated offset shaft 250 extending through a channel 248 in the drive module 208. The housing may rest partially or wholly on the base unit 206, for example on support members 244, or may be supported entirely or partially on the wall surface 12 by the bracket 58. Regardless of how it is supported, once the housing is mounted to the bracket 58, the pump mechanism, particularly the front face 93 of the pump cylinder 92, is engaged against the motor driven actuator 226 as described above.

Figure 12:
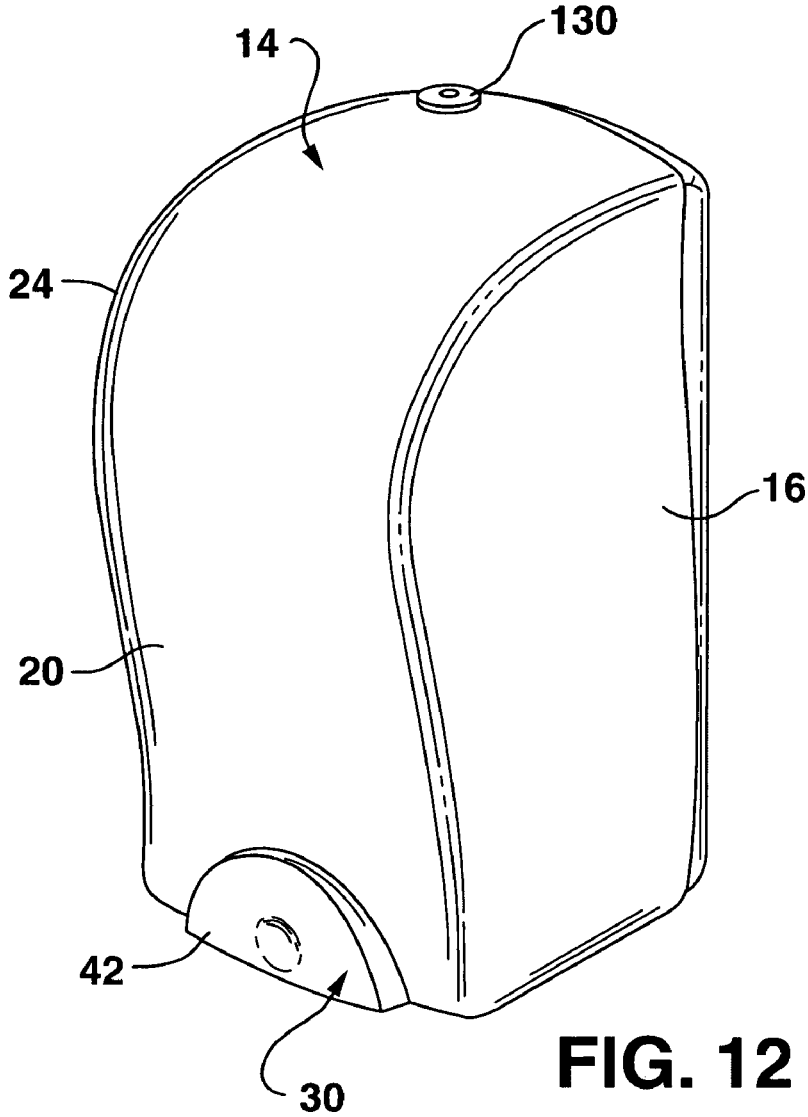
FIG. 12 is a perspective view of a housing unit incorporating a manual actuator in addition to a motor driven actuator.
Figure 13:
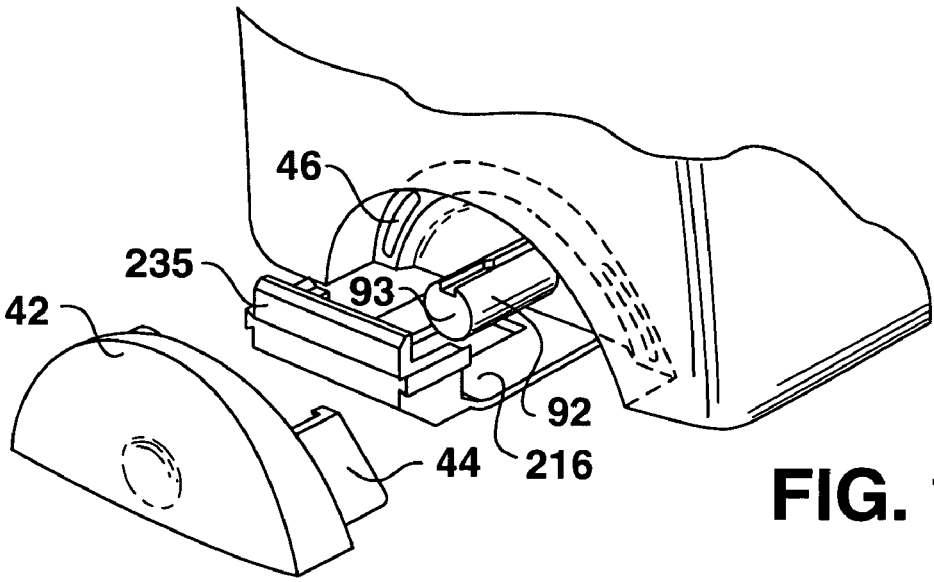
FIG. 13 is a detailed perspective view of the manual actuator of the embodiment of FIG. 12.

It may also be desired to provide a manual actuator configured with the housing 14 in the event that the electronic actuating mechanism 215 is vandalized or otherwise becomes inoperative. FIGS. 12 and 13 illustrate a housing 14 including a manual push actuator 30 having flanges 44 extending rearwardly from a push plate 42 and slidably engaged in channels or slots 46 defined in the housing 14. As seen in FIG. 13, the motor driven actuator 216 extends between the front face 93 of the cylinder 92 and the push plate 42 such that the actuator 216 and cylinder are not visible from the front side of the housing 14. The motor driven actuator 216 would function as described above. However, in the event that the actuator 216 becomes inoperative, the dispenser 10 can still be operated by a user manually pushing on the plate 42 to move the pump cylinder 92 to its dispensing position. Unless a clutch mechanism were provided, the actuator 216 would still be engaged with the motor 218 and, thus, the cylinder 92 and actuator 216 would be pushed against the inertial of the resting (un-powered) motor 218. However, the motor 218 need not be of a size so as to prevent such manual actuation without disengagement of the actuator 216 from the motor and the user can readily push the manual actuator and motor driven actuator 216 against the inertia of the motor 218. The internal spring 98 within the pump chamber 70 would also have enough force to return the pump cylinder 92 to its position against the inertia of the un-powered motor.

Figure 11:
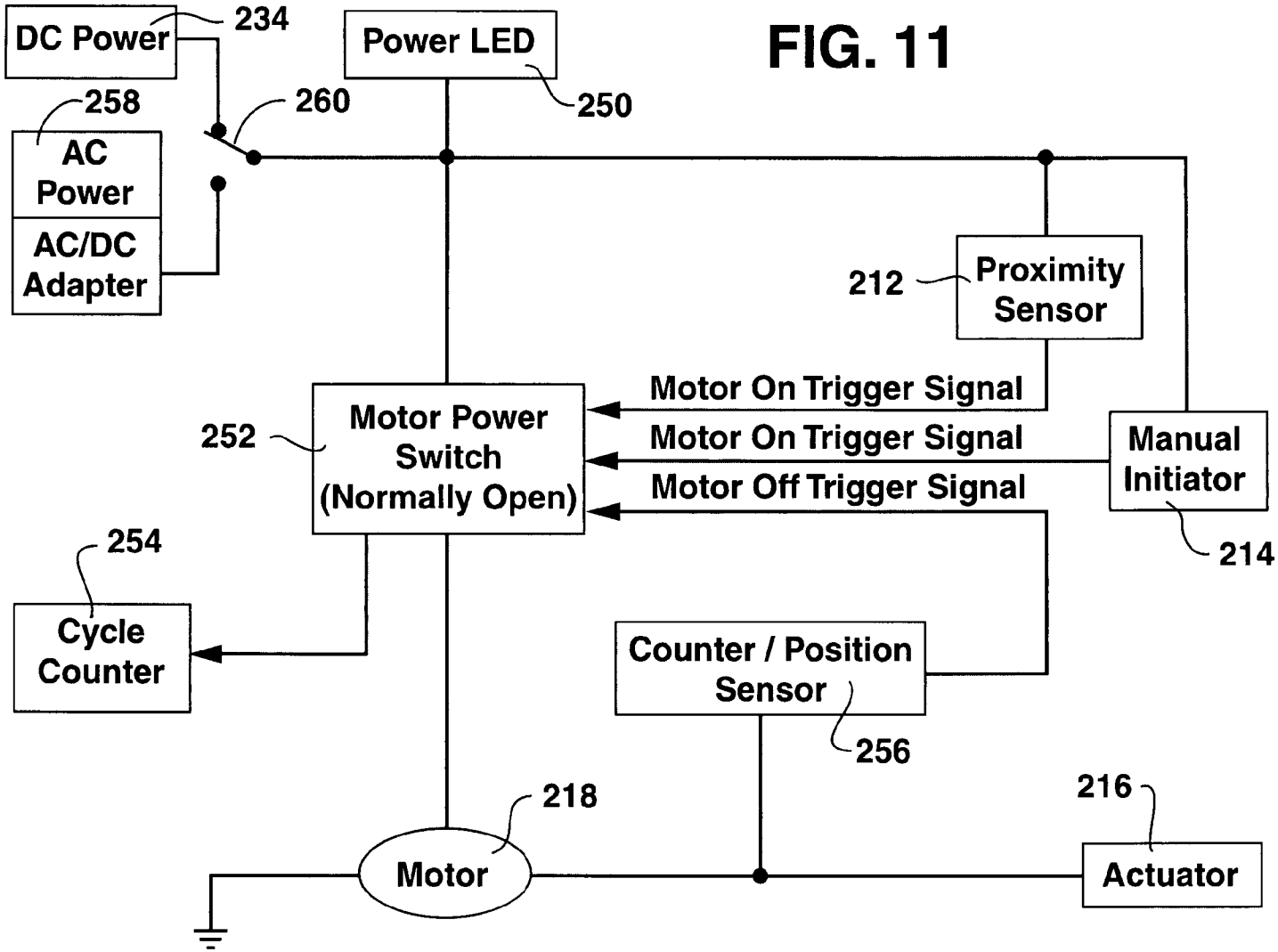
FIG. 11 is functional block diagram of an embodiment of suitable control circuitry that may be incorporated with dispensers according to the invention.

A block diagram of a relatively simple embodiment of a control circuit is provided by way of FIG. 11. As mentioned, the components of the control circuit may be housed in any suitable location in the mounting assembly 200 or drive module 208. The circuit includes a power source, such as the battery DC source described above. Alternately, power may be supplied from an AC system and include an adapter or converter for converting the AC power to DC power. In this embodiment, the dispenser may be thus "hard-wired" to a buildings AC power distribution system. It may also be desired that the dispensers be capable of operating by internal battery power or external power. In this case a switch 260 can be provided to select between the desired power source. A power indicator, such as the LED 250, can be provided anywhere on the mounting assembly 220 or drive module 208 to readily indicate to a maintenance technician whether the dispenser has power or not.

A motor power switch 252 is provided to direct power to the motor 218 at the appropriate time. The switch 252 may be in a normally open condition and close upon certain activation events to initiate a dispense cycle. For example, a proximity sensor 212 may be configured with the mounting assembly 200 or drive module 208, as discussed above, to generate a "motor on" trigger signal upon detecting the presence of a user. The sensor 212 may be located at any suitable location to initiate a dispense cycle when the user places their hands in proximity to the sensor 212. The sensor 212 may be any one or combination of known sensors, including infra-red sensors, heat detection sensors, motion sensors, and so forth. Such sensors are conventionally used in public restrooms to automatically activate water faucets or toilet flush sequences upon detection of a user, and are well known to those skilled in the art. The sensor 212 may also be configured with logic circuitry to prevent or diminish false dispensing sequences. For example, the logic circuitry may include a time requirement wherein the user's hands must be detected for a threshold period of time before the trigger signal is initiated to prevent dispensing the liquid upon a person inadvertently passing their hands below the dispenser 10.

As mentioned above, the dispenser 10 may also include a manual initiator 214 alone or in combination with the proximity sensor 212 wherein the trigger signal for the motor power switch 252 is initiated by the user manually pushing a button or other activation device.

Once the switch 252 is closed, power is directed to the motor 218 causing the motor to drive the pump mechanism 88 as described above. It should be understood that, with the embodiments described, the motor 218 need only be driven for one complete revolution of the offset drive cam 22 for each dispense cycle, at which time a "motor off" trigger cycle is generated to open the switch 252. This signal may be generated by, for example, a counter or position sensor 256 that detects revolutions of the motor shaft or of the drive cam 22. For example, a revolution counter such as a typical tachogenerator may be positioned to detect revolutions of a vane or other structure configured with the drive cam 22. When the detected count indicates that the drive cam 22 has returned to its initial "at rest" position, the "motor off" signal is generated and the power switch 252 opens causing the motor 218 to shut off. The position sensor 256 may be any one or combination of suitable detectors, including optical sensors, mechanical sensors, and so forth.

A cycle counter 254 may also be provided. This counter 254 would register a count for each dispensing cycle and provide to a maintenance technician a total count of dispensing cycles between change-out of the housings 14. In this way, the fullness state of the housing 14 may be readily determined. The counter 254 may be any suitable counter that simply detects and registers each cycle of the motor power switch 252, actuator 216, or any other structure that indicates that a dispense cycle has been completed. By knowing the approximate number of dispenses (cycles) contained in the reservoir, the counter 254 can be used to notify when it is time to exchange housings 14 by, for example, digitally displaying the total counts, or via a signal (i.e., an LED) once a certain count has been reached.

It should be appreciated that the control circuitry of FIG. 11 is but one example of countless control configurations available to those skilled in the art that may be used for dispensers according to the invention. It is intended that the invention include such variations of control circuitry.

It should also be appreciated that the invention includes modifications and variations to the structure of the housing, mounting assembly, drive module, and other structural elements of the embodiments of the invention described herein.

What is claimed is:

1. An electronic self contained viscous liquid dispenser, comprising:

a housing defining an internal liquid reservoir, said housing including front surface having an opening therethrough adjacent a bottom surface of said reservoir;

a dispensing pump mechanism carried by said housing and disposed in liquid communication with said reservoir, said pump mechanism having a delivery end disposed for delivering metered doses of viscous liquid from said reservoir;

a mounting assembly configured for mounting on a supporting wall structure, said housing with internal liquid reservoir and dispensing pump mechanism being completely removable from and replaceable relative to said mounting assembly, when attached to said mounting assembly, said housing defining a front visible surface of said dispenser;

an electronic actuating mechanism carried by said mounting assembly and comprising a motor driven actuator that engages with said pump mechanism upon insertion of said housing into said mounting assembly;

a motor and associated power supply circuitry carried by said mounting assembly, said motor in driving engagement with said motor driven actuator;

wherein said dispensing pump mechanism is movable in a horizontal direction relative to said housing for actuation thereof, said motor driven actuator comprising a member slidable in a horizontal path to engage and move said dispensing pump mechanism to a dispensing position; and wherein said dispensing pump mechanism comprises a linearly slidable cylinder having a delivery channel defined therethrough terminating at said delivery end, said cylinder being slidable within a substantially horizontally disposed pump chamber defined within said reservoir, said motor driven actuator slidable in a horizontal path to engage and move said cylinder to said dispensing position within said pump chamber.

2. The dispenser as in claim 1, wherein said cylinder is drivingly engaged by said motor driven actuator as said cylinder moves from a rest position to said dispensing position and drivingly disengaged with said motor driven actuator as said cylinder moves from said dispensing position to said rest position.

3. The dispenser as in claim 1, wherein said pump chamber is formed integral with said housing within said reservoir and has a back end open to said reservoir and a front end open to an outside of said housing, said delivery end of said cylinder extending out of said front end of said pump chamber and engaged by said motor driven actuator.

4. The dispenser as in claim 1, wherein said motor comprises an off-center drive cam engaged within an elongated cam surface defined in said motor driven actuator such that rotational movement of said motor is converted to linear movement of said motor driven actuator.

5. The dispenser as in claim 1, further comprising a battery power supply carried by said mounting assembly.

6. The dispenser as in claim 1, wherein said mounting assembly comprises an enclosed back unit mountable against the supporting wall structure, said motor and associated power supply contained within said back unit, said motor driven actuator horizontally disposed below said back unit.

7. The dispenser as in claim 6, wherein said housing is supported entirely by said back unit.

8. The dispenser as in claim 7, further comprising a mounting mechanism configured between said housing said back unit, said mounting mechanism comprising a mounting bracket provided on said back unit and a recess formed integrally in a back side of said housing, said recess further comprising side walls having engaging structures defined thereon for engagement with complimentary structure provided on said mounting bracket.

9. The dispenser as in claim 8, wherein said recess has dimensions so that said complimentary structure on said mounting bracket fits entirely within said recess, wherein upon mounting said housing to said mounting assembly, said back side of said housing is flush against a front wall of said back unit.

10. The dispenser as in claim 1, wherein said mounting assembly comprises an enclosed top unit disposed above said housing, said motor and associated power supply contained within said top unit, said motor driven actuator horizontally disposed below said housing, and further comprising a gear drive between said motor and said motor driven actuator.

11. The dispenser as in claim 1, wherein said mounting assembly comprises a base unit, said motor driven actuator slidable within said base unit.

12. The dispenser as in claim 11, wherein said housing is restable on said base unit.

13. The dispenser as in claim 11, wherein said housing is supported by said mounting assembly above said base unit.

14. The dispenser as in claim 11, wherein said motor and associated power supply are contained in said base unit.

15. The dispenser as in claim 1, wherein said electronic actuating mechanism comprises a manual initiator.

16. The dispenser as in claim 1, further comprises a sensor that actuates said electronic actuating mechanism upon sensing a presence of a user.

17. The dispenser as in claim 1, wherein said housing further comprises a manual actuator configured with said dispensing pump mechanism.

18. An electronic self contained viscous liquid dispenser, comprising:

a housing defining an internal liquid reservoir, said housing including a front surface having an opening therethrough adjacent a bottom surface of said reservoir;

a dispensing pump mechanism carried by said housing and disposed in liquid communication with said reservoir, said pump mechanism having a delivery end disposed for delivering metered doses of viscous liquid from said reservoir;

a mounting assembly configured for mounting on a supporting wall structure, said housing with internal liquid reservoir and dispensing pump mechanism being completely removable from and replaceable relative to said mounting assembly, when attached to said mounting assembly, said housing defining a front visible surface of said dispenser;

an electronic actuating mechanism carried by said mounting assembly and comprising a motor driven actuator that engages with said pump mechanism upon insertion of said housing into said mounting assembly;

a motor and associated power supply circuitry carried by said mounting assembly, said motor in driving engagement with said motor driven actuator;

wherein said dispensing pump mechanism is movable in a horizontal direction relative to said housing for actuation thereof, said motor driven actuator comprising a member slidable in a horizontal path to engage and move said dispensing pump mechanism to a dispensing position;

wherein said motor comprises an off-center drive cam engaged within an elongated cam surface defined in said motor driven actuator such that rotational movement of said motor is converted to linear movement of said motor driven actuator; and wherein said motor driven actuator comprises an elongated plate member slidably supported in said mounting assembly at a position below said housing, said plate member having a front end engaged with said pump mechanism, said cam surface defined in an opposite back end of said plate member, and further comprising an opening defined in said front end of said plate member aligned with said delivery end of said pump mechanism.

* * * * *